US010905296B2

(12) United States Patent
Windmeisser et al.

(10) Patent No.: US 10,905,296 B2
(45) Date of Patent: Feb. 2, 2021

(54) FLOOR CLEANING TOOL AND METHOD

(71) Applicant: Diversey, Inc., Sturtevant, WI (US)

(72) Inventors: Dieter Windmeisser, Fruthwilen (CH); Andre Bartsch, Rossruti (CH); Jerry Auerswald, Constance (DE); Thomas Bahr, Wangi (CH); Beat Stager, Wangi (CH); Phillip Jahde, Aadorf (CH); Josef Kuzhnini, Wil (CH)

(73) Assignee: Diversey, Inc., Fort Mill, SC (US)

( * ) Notice: Subject to any disclaimer, the term of this patent is extended or adjusted under 35 U.S.C. 154(b) by 514 days.

(21) Appl. No.: 15/419,479

(22) Filed: Jan. 30, 2017

(65) Prior Publication Data

US 2017/0135542 A1 May 18, 2017

Related U.S. Application Data

(63) Continuation of application No. 14/183,037, filed on Feb. 18, 2014, now abandoned, which is a (Continued)

(51) Int. Cl.
*A47L 9/04* (2006.01)
*A47L 11/19* (2006.01)
(Continued)

(52) U.S. Cl.
CPC ..... *A47L 9/0455* (2013.01); *A47L 9/0477* (2013.01); *A47L 11/19* (2013.01); *A47L 11/302* (2013.01);
(Continued)

(58) Field of Classification Search
CPC .. A47L 9/0477; A47L 9/0455; A47L 11/4041; A47L 11/18; A47L 11/19
See application file for complete search history.

(56) References Cited

U.S. PATENT DOCUMENTS 2,842,788 A 7/1958 Rench et al.
3,065,490 A 11/1962 Arones
(Continued)

FOREIGN PATENT DOCUMENTS

DE 19607368 10/1996
DE 19728441 10/1998
(Continued)

OTHER PUBLICATIONS

PCT/US2011/034299 International Search Report and Written Opinion dated Feb. 9, 2012.
(Continued)

*Primary Examiner* — Bryan R Muller
(74) *Attorney, Agent, or Firm* — Michael Best & Friedrich LLP

(57) ABSTRACT

A floor cleaning tool including a housing, a reservoir coupled to the housing and adapted to hold a cleaning solution, and a floor-engaging roller coupled to the housing and rotatable with respect to the housing. The tool also includes a wheel by which the floor cleaning tool moves across a floor surface in a direction of travel at least partially defining a front, rear, and lateral sides of the floor cleaning tool. The tool further includes a squeegee laterally insertable between the roller and the wheel, and a squeegee mount located between the roller and the wheel by which the squeegee is releasably mounted to the floor cleaning tool by first and second laterally opposed protrusions rotatably secured within first and second apertures at opposite ends of the squeegee.

13 Claims, 20 Drawing Sheets

Related U.S. Application Data continuation of application No. 13/695,080, filed as application No. PCT/US2011/034299 on Apr. 28, 2011, now abandoned.

(60) Provisional application No. 61/329,184, filed on Apr. 29, 2010.

(51) Int. Cl.
*A47L 11/18* (2006.01)
*A47L 11/40* (2006.01)
*A47L 11/30* (2006.01)

(52) U.S. Cl.
CPC ..... *A47L 11/4041* (2013.01); *A47L 11/4044* (2013.01); *A47L 11/4077* (2013.01); *A47L 11/18* (2013.01); *A47L 11/4075* (2013.01); *Y10T 29/49826* (2015.01)

(56) References Cited

U.S. PATENT DOCUMENTS 3,168,157 A 2/1965 Ulinski
3,190,994 A 6/1965 Becker et al.
3,233,274 A 2/1966 Kroll
3,284,830 A * 11/1966 Kroll ..... A47L 11/4069 15/52.1
3,465,841 A 9/1969 Pulskamp et al.
3,466,690 A 9/1969 Cooper
3,533,120 A 10/1970 De Meracdo
3,791,474 A 2/1974 Stammen et al.
3,931,662 A 1/1976 Nayfa et al.
4,063,961 A 12/1977 Howard et al.
4,150,456 A 4/1979 Alvarez et al.
4,245,371 A 1/1981 Satterfield
4,363,152 A 12/1982 Karpanty
4,709,771 A 12/1987 Basham et al.
4,825,500 A 5/1989 Basham et al.
4,900,881 A 2/1990 Fischer
5,033,326 A 7/1991 Powell et al.
5,044,043 A 9/1991 Basham et al.
5,064,010 A 11/1991 Masbruch et al.
5,212,848 A 5/1993 Geyer
5,231,725 A * 8/1993 Hennessey ..... E01H 1/056 15/179
5,239,721 A * 8/1993 Zahuranec ..... A47L 11/32 15/41.1
5,245,144 A 9/1993 Stammen
5,369,838 A 12/1994 Wood et al.
5,404,609 A 4/1995 Rench et al.
5,509,162 A * 4/1996 Burgoon ..... A47L 11/24 15/340.3
5,595,259 A 1/1997 Gilliland et al.
5,819,352 A * 10/1998 Bancroft ..... A47L 11/24 15/52.1
5,933,911 A 8/1999 Windmeisser
5,953,781 A 9/1999 Sletten, II et al.
5,964,313 A 10/1999 Guy
6,101,672 A 8/2000 Conrad et al.
6,105,203 A 8/2000 Hueppi et al.
6,108,859 A 8/2000 Burgoon
6,134,744 A * 10/2000 Kasen ..... A47L 11/4011 15/320
6,276,485 B1 8/2001 Eriksson et al.
6,321,406 B1 11/2001 Kloepfer et al.
6,389,630 B1 5/2002 Chen
6,464,025 B1 10/2002 Koeper et al.
6,595,306 B2 7/2003 Trego et al.
6,602,018 B2 8/2003 Fenny et al.
6,883,625 B2 4/2005 Trego et al.
7,013,527 B2 3/2006 Thomas, Sr. et al.
7,017,689 B2 3/2006 Gilliland et al.
7,025,157 B2 4/2006 Lindsay et al.
7,040,427 B2 5/2006 Toomey
7,237,645 B2 7/2007 Lohmann et al.
7,281,298 B2 10/2007 Joung et al.
7,293,317 B2 11/2007 Tsuchiya et al.
7,325,655 B2 2/2008 Lohmann et al.
7,373,690 B2 5/2008 Sepke et al.
7,383,915 B2 6/2008 David et al.
7,392,868 B2 7/2008 Johansson et al.
7,617,564 B2 11/2009 Stuthers et al.
8,166,606 B2 5/2012 Johnson et al.
8,607,411 B2 12/2013 Dominguez et al.
2002/0006307 A1 1/2002 Feeny et al.
2002/0050023 A1 5/2002 Stuchlik
2002/0092122 A1 7/2002 Zahuranec et al.
2004/0099453 A1 5/2004 Guy
2005/0251937 A1 11/2005 Ruffo
2006/0064828 A1* 3/2006 Stein ..... A47L 9/0455 15/41.1
2006/0101613 A1 5/2006 Wood
2006/0156509 A1 7/2006 Luebbering et al.
2006/0231301 A1 10/2006 Rose et al.
2006/0231302 A1 10/2006 Rose
2007/0074369 A1 4/2007 Stuthers et al.
2007/0137904 A1 6/2007 Rose et al.

FOREIGN PATENT DOCUMENTS

DE 102005045669 B3 * 3/2007 ..... A47L 11/40
DE 102005045669 B3 3/2007
EP 0951858 10/1999
JP S60134462 9/1985
JP S63102713 5/1988
JP H055058 1/1993
JP 05-300855 11/1993
JP 08-047343 2/1996
JP 3033894 2/1997
JP 09-168493 6/1997
JP 10-023926 1/1998
JP 2001-095737 4/2001
JP 2004-049619 2/2004
JP 2004-113263 4/2004
JP 2008-206725 9/2008
JP 2008-220898 9/2008
KR 10-2005-0094963 9/2005
WO WO 93/19659 10/1993
WO WO 2005/032735 4/2005
WO WO 2006/078580 7/2006
WO WO 2007/092322 8/2007

OTHER PUBLICATIONS

Office Action from the Japanese Intellectual Property Office for Application No. 2013508246 dated Mar. 26, 2010 (6 pages).
EP11778002.3 Partial European Search Report dated Aug. 19, 2016 (6 pages).
EP11778002.3 Partial European Search Report dated Dec. 13, 2016 (9 pages).
Partial European Search Report for Application No. 19172808.8 dated Aug. 19, 2019 (14 pages).
European Patent Office Extended Search Report for Application No. 19172808.8 dated Nov. 19, 2019 (13 pages).

* cited by examiner

FLOOR CLEANING TOOL AND METHOD

CROSS-REFERENCE TO RELATED APPLICATIONS

This application is a continuation of U.S. patent application Ser. No. 14/183,037, filed Feb. 18, 2014, which is a continuation of U.S. patent application Ser. No. 13/695,080, filed Oct. 29, 2012, which is a U.S. national phase application filing of International Patent Application No. PCT/US2011/034299, filed Apr. 28, 2011, which claims the benefit of and priority to U.S. Provisional Patent Application No. 61/329,184, filed Apr. 29, 2010, the entire contents of each of which are incorporated herein by reference.

BACKGROUND

Numerous powered floor cleaning tools exist in the marketplace, each of which attempt to address a large number of characteristics that are commonly desired by users. For example, in some cases, a floor cleaning tool that can be placed in a compact state to take up minimum storage space is of high importance. As another example, a floor cleaning tool easily adapted to different users (e.g., user height, arm length, and the like) is needed. Still other examples of desired floor cleaning tool characteristics include floor cleaning tool handles and controls that are easy to use and intuitive, and floor cleaning tools that are easy to service and replace (such as for removal, service, and replacement of floor cleaning tool brushes, cleaning and maintenance of internal parts of the floor cleaning tool, and removal and replacement of squeegee blades and other parts.

Unfortunately, despite the advanced age of powered floor cleaning tool technology, significant advancements in each of these features has been slow or non-existent. Nevertheless, based upon the value such advancements provide for users and servicers of powered floor cleaners, new and improved powered floor cleaners continue to be welcome in the industry.

SUMMARY

Some embodiments of the present invention provide a floor cleaning tool, comprising: a housing, a reservoir coupled to the housing and adapted to hold a cleaning solution, at least one wheel by which the floor cleaning tool moves across a floor surface in a direction of travel, the direction of travel at least partially defining a front, rear, and lateral sides of the floor cleaning tool, and a handle including a proximal end and a distal end, the handle pivotable about an axis extending laterally with respect to the direction of travel of the floor cleaning tool.

In some embodiments, a floor cleaning tool is provided, and comprises: a housing, a roller rotatable with respect to the housing about an axis extending in an axial direction, a bracket having a first portion extending in the axial direction of the roller and shaped to releasably and matingly engage the housing, and a second portion extending in the axial direction of the roller and shaped to releasably and matingly engage an end of the roller, the roller rotatable with respect to the second portion of the bracket, and a fastener engaged with the first portion of the bracket, the bracket releasably and removably coupled to the roller and to the housing via the fastener.

Some embodiments of the present invention provide a method for coupling a roller to a floor cleaning tool, the roller having an axis of rotation extending in an axial direction, the method comprising: laterally inserting the roller onto the floor cleaning tool, coupling an end of the roller to the floor cleaning tool by mating a spindle within a receptacle, coupling a bracket to an end of the roller, engaging a portion of the bracket extending in the axial direction with the floor cleaning tool, engaging the portion of the bracket with a fastener to secure the bracket to the floor cleaning tool, supporting the roller for rotation with respect to the floor cleaning tool via the spindle in the receptacle, and resisting rotation of the bracket with respect to the floor cleaning tool via engagement of the portion of the bracket with the floor cleaning tool.

In some embodiments, a floor cleaning tool is provided, and comprises: a housing, a reservoir coupled to the housing and shaped to contain a cleaning solution, a resiliently deformable plate coupled to the housing and defining a plurality of apertures, and a conduit extending from the reservoir to the plate and establishing fluid communication between the reservoir and the plate for delivery of cleaning solution from the reservoir, through the conduit, and through the plurality of apertures in the resiliently deformable plate, the resiliently deformable plate removable from the conduit and the housing for cleaning and replacement.

Some embodiments of the present invention provide a floor cleaning tool including a housing, a reservoir coupled to the housing and adapted to hold a cleaning solution, a floor-engaging roller coupled to the housing and rotatable with respect to the housing, a wheel by which the floor cleaning tool moves across a floor surface in a direction of travel, the direction of travel at least partially defining a front, rear, and lateral sides of the floor cleaning tool, a squeegee laterally insertable between the roller and the wheel, and a squeegee mount located between the roller and the wheel by which the squeegee is releasably mounted to the floor cleaning tool.

In some embodiments, a method of installing a squeegee assembly on a floor cleaning tool adapted to move in a direction of travel defining a front, rear, and lateral sides of the floor cleaning tool is provided, and includes laterally inserting the squeegee assembly below the floor cleaning tool, raising the squeegee assembly to insert a projection of the squeegee assembly into a mating aperture of the floor cleaning tool, and rotating the projection to releasably couple the squeegee assembly to the floor cleaning tool.

Some embodiments of the present invention provide a floor cleaning tool including a housing, a handle rotatably coupled to the housing, a user-manipulatable control, and a lock coupled to the user-manipulatable control, the lock movable from a locked state to an unlocked state by actuation of the user-manipulatable control, the lock maintaining the handle in one of a plurality of rotational positions with respect to the housing when in the locked state, releasable to permit the handle to be moved to another of the plurality of rotational positions with respect to the housing, and movable to the locked state again to maintain the handle in the other of the plurality of rotational positions.

In some embodiments, the present invention provides a floor cleaning tool including a housing, a reservoir coupled to the housing and adapted to hold a cleaning solution, and a floor-engaging roller coupled to the housing and rotatable with respect to the housing. The tool also includes a wheel by which the floor cleaning tool moves across a floor surface in a direction of travel, the direction of travel at least partially defining a front, rear, and lateral sides of the floor cleaning tool, a squeegee mount disposed on an underside of the floor cleaning tool, and a squeegee laterally insertable into the housing along the underside of the tool and removably coupled to the squeegee mount.

Other aspects of the invention will become apparent by consideration of the detailed description and accompanying drawings.

DETAILED DESCRIPTION

Figure 1:
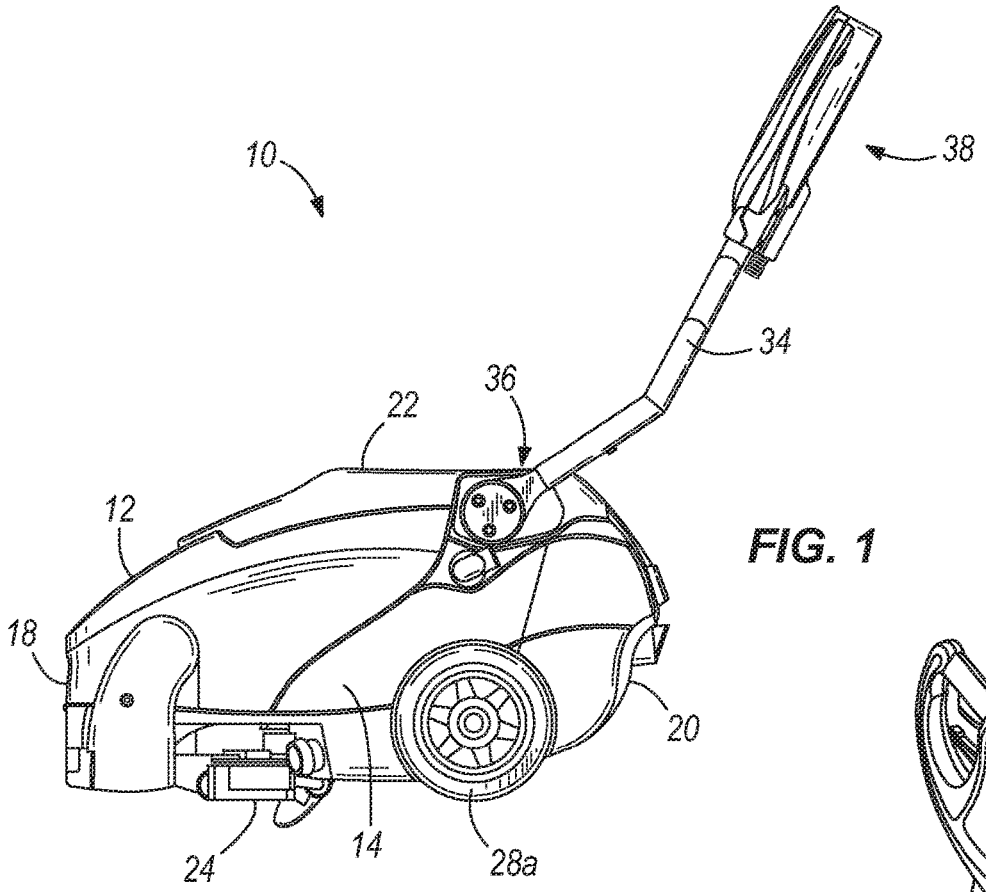
FIG. 1 is a left side view of a floor cleaning tool.
Figure 2:
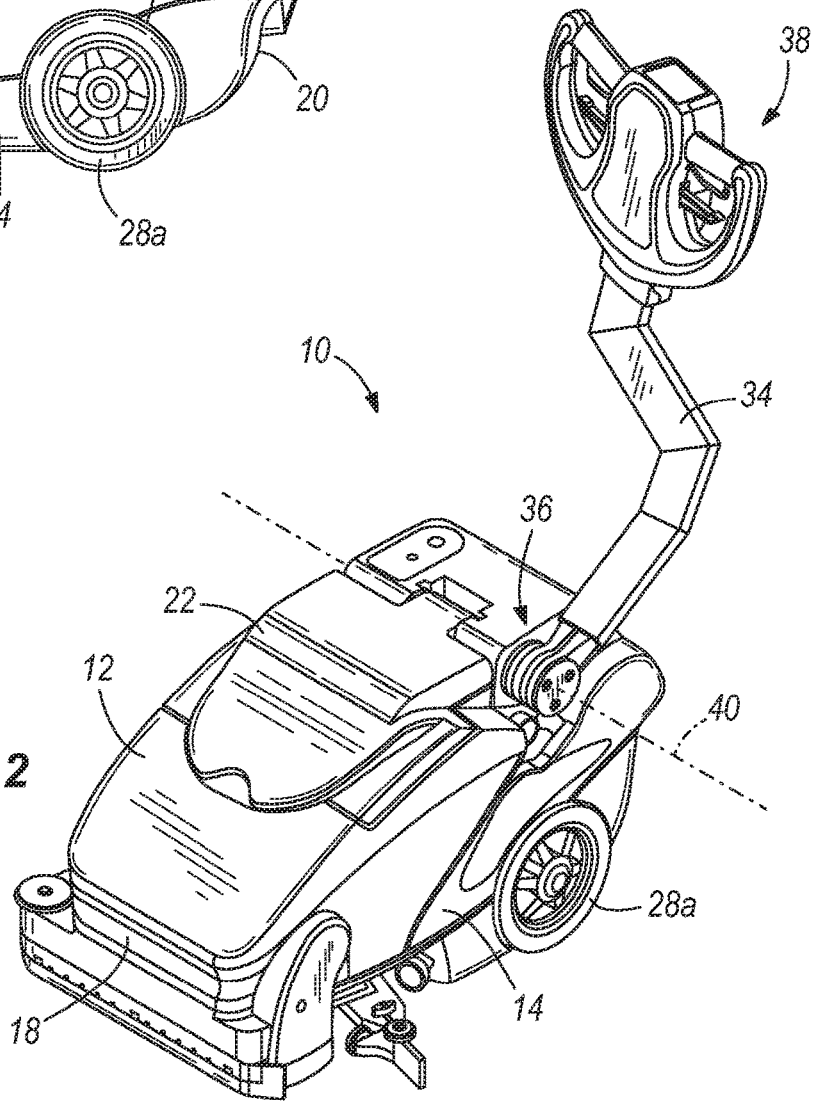
FIG. 2 is a perspective view of the floor cleaning tool of FIG. 1.
Figure 3:
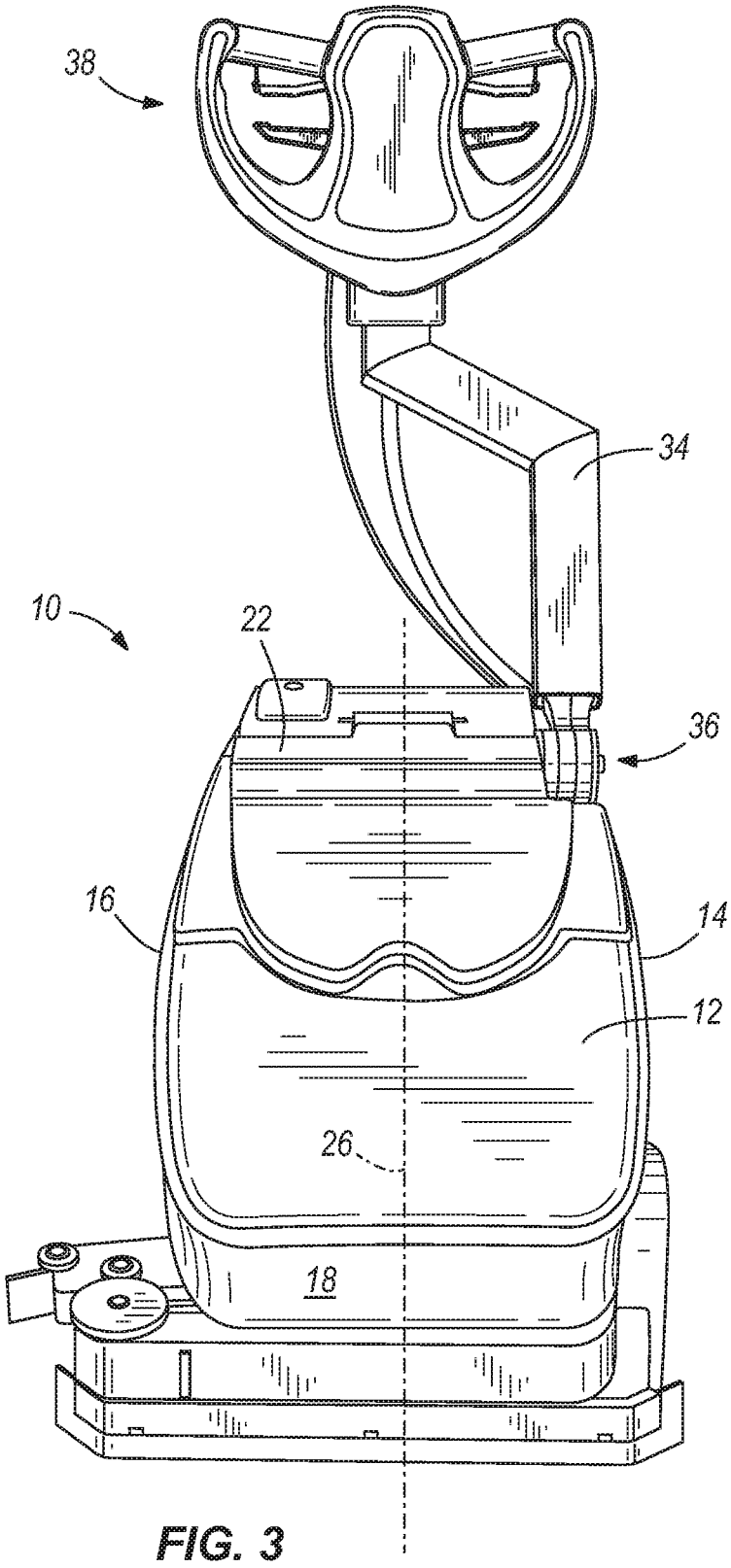
FIG. 3 is a front view of the floor cleaning tool of FIGS. 1 and 2.
Figure 4:
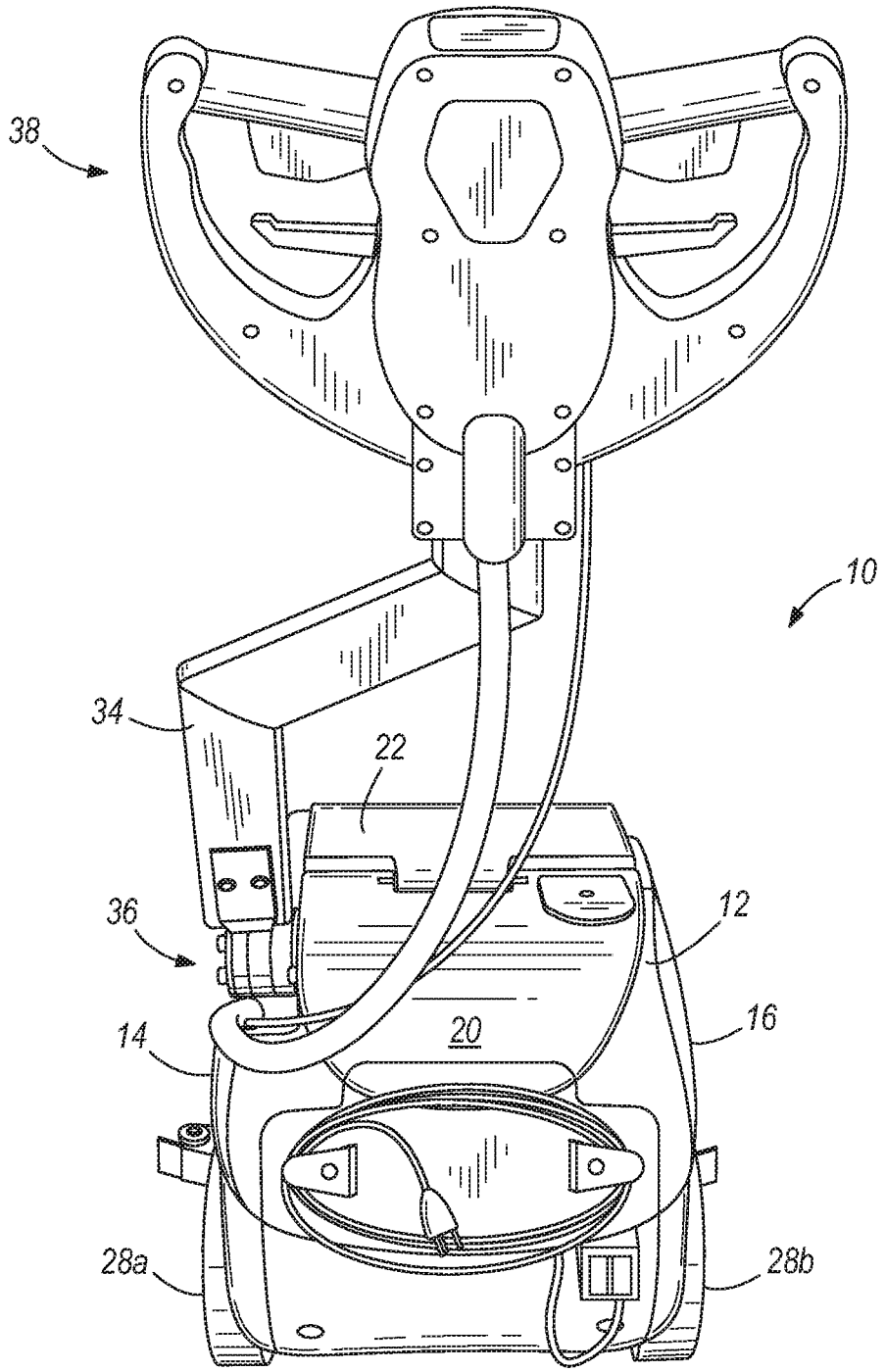
FIG. 4 is a rear view of the floor cleaning tool of FIGS. 1-3.

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-7 illustrate a floor cleaning tool 10 according to an embodiment of the present invention. The illustrated floor cleaning tool 10 includes a housing 12, first and second wheels 28*a*, 28*b* supporting the housing 12 for movement across a surface, a first reservoir 30 for containing a cleaning product in any form (e.g., fluid, powder, and the like), and a roller 86 for performing a cleaning operation upon the surface. The floor cleaning tool 10 described and illustrated herein has two wheels 28*a*, 28*b*, although any other number of wheels are possible, such as for a three or four-wheeled floor cleaning tool 10. The wheels 28*a*, 28*b* of the illustrated floor cleaning tool 10 are powered by a motor (not shown). However, in other embodiments, any or all of the wheels of the floor cleaning tool 10 can be non-powered. Also, the wheels 28*a*, 28*b* can take any of a number of forms well-known to those skilled in the art, such as wheels 28*a*, 28*b* mounted to rotate about and/or with a fixed axle, caster wheels capable of rotating and spinning to different orientations, and the like.

Although the floor cleaning tool 10 described and illustrated in the accompanying drawings includes wheels 28*a*, 28*b* for movement of the floor cleaning tool 10 over a surface, it will be appreciated that other types of devices can be used to move the floor cleaning tool 10, including without limitation powered or un-powered tracks. For the sake of simplicity, the term "wheel" as used herein and in the appended claims refers to all such moving elements.

The floor cleaning tool 10 is movable along a direction determined at least in part by the orientation of the wheels 28*a*, 28*b*. For example, the illustrated floor cleaning tool 10 is movable along a direction of travel parallel to the axis 26 shown in FIG. 3, which is determined by the rolling direction of the illustrated wheels 28*a*, 28*b*. This direction of travel defines opposite lateral sides 14, 16 of the floor cleaning tool 10, as well as a front 18 and rear 20 of the tool 10. The floor cleaning tool 10 also includes a top 22 and bottom 24.

As mentioned above, the floor cleaning tool 10 can have a reservoir 30 for containing a cleaning product. The reservoir 30 can be located within the housing 12 of the floor cleaning tool 10, and can be one of any number of reservoirs 30 containing the same or different cleaning products that in some embodiments can be dispensed independently from one another, can be mixed prior to or as the cleaning products are discharged upon a surface to be cleaned, and/or can be discharged at different locations upon the surface to be cleaned.

Figure 5:
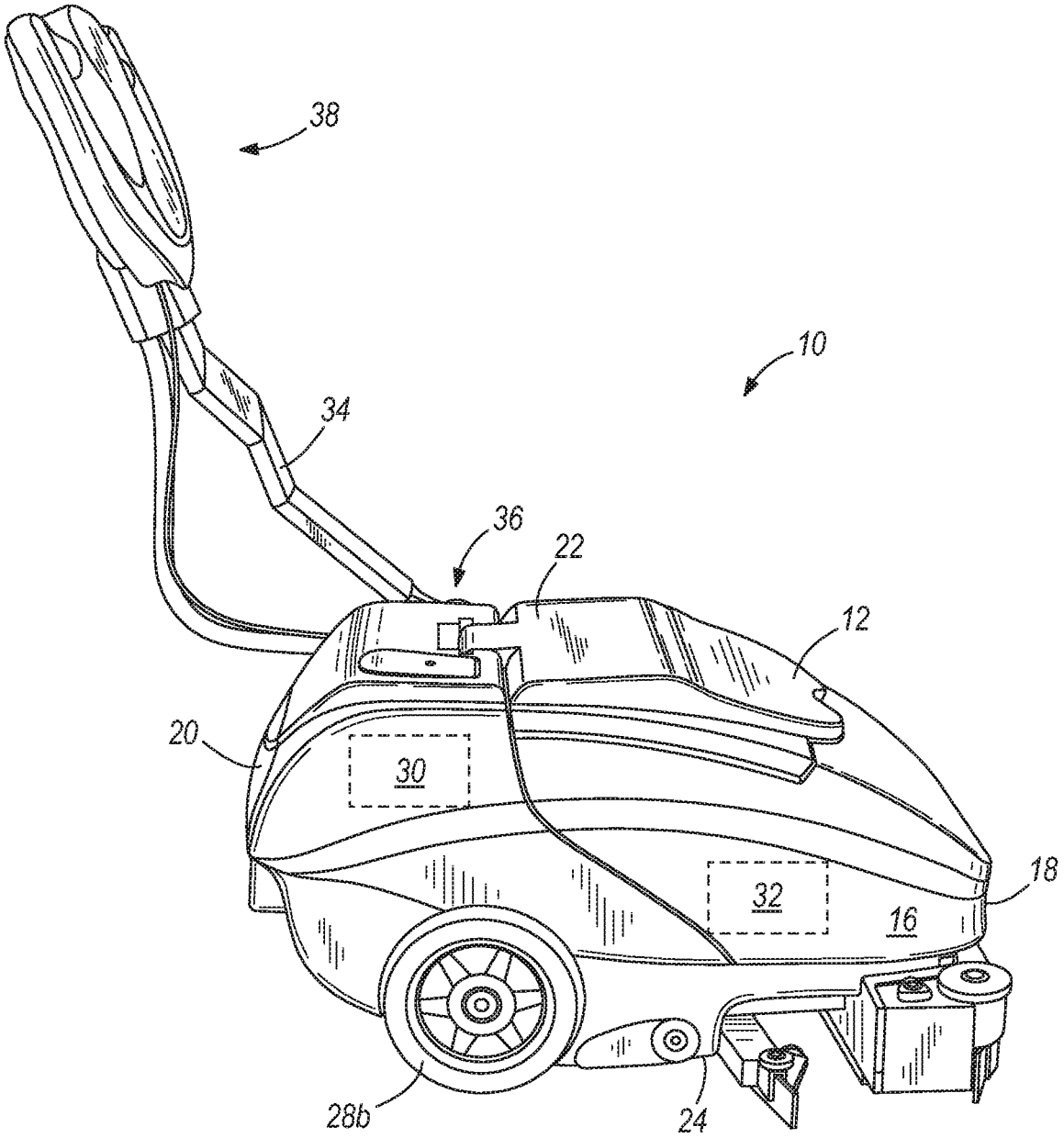
FIG. 5 is a right side perspective view of the floor cleaning tool of FIGS. 1-4, shown with a handle in a first position.
Figure 6:
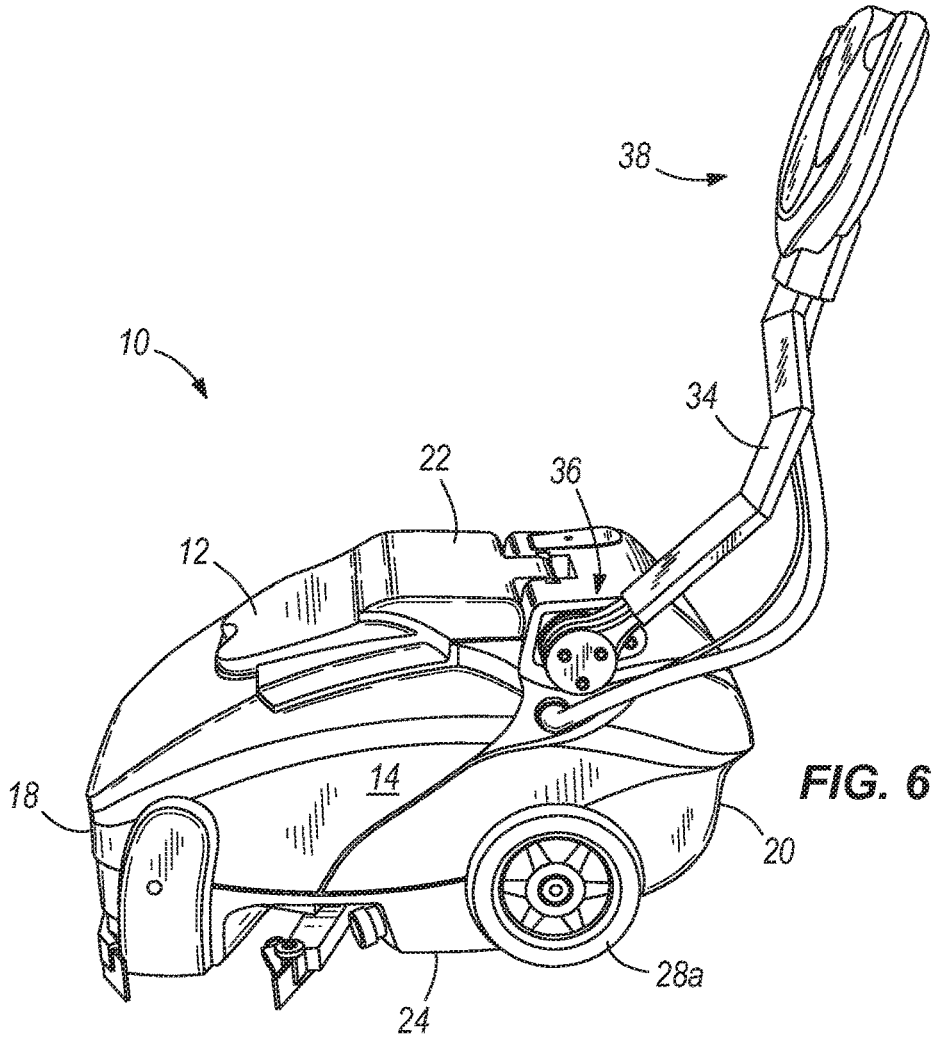
FIG. 6 is a left side perspective view of the floor cleaning tool of FIGS. 1-5, shown with the handle in the position of FIG. 5.

In some embodiments, the floor cleaning tool 10 includes one or more reservoirs 32 for containing used cleaning product (see FIG. 5). The used cleaning product can be drawn into the floor cleaning tool by vacuum force, and in some cases can pass through one or more filters to filter the cleaning product after use and/or to recycle the used cleaning product for re-use.

As shown in FIGS. 1-7, the illustrated floor cleaning tool 10 includes a handle 34 having a proximal end 36 and a distal end 38. The proximal end 36 is coupled to a side 14 of the housing 12 (with reference to the direction of travel of the floor cleaning tool as described above). In other words, the attachment location of the proximal end 36 of the handle 34 is located completely to one lateral side of a central plane bisecting the floor cleaning tool 10 (i.e., into opposite lateral sides as described above). In the illustrated embodiment of FIGS. 1-7, the axis 26 described above lies in this central plane.

In some embodiments, the handle 34 is coupled for rotation relative to the housing 12. This rotation can be about an axis 40 extending laterally with respect to the sides 14, 16 of the floor cleaning tool 10 (described above). The distal end 38 of the handle 34 extends away from the housing 12 to a location disposed a distance from the body 12 of the floor cleaning tool 10. In the illustrated embodiment of FIGS. 1-7, the distal end 38 of the handle 34 is substantially aligned with (i.e., lies within) a plane bisecting the floor cleaning tool 10 into opposite lateral sides as described above. To connect a centrally-aligned distal end 38 and a laterally-disposed proximal end 36 of the handle 34, the handle 34 can be shaped to include an offset or "jogged" portion extending laterally at a location between the distal and proximal ends 36, 38.

Figure 7:
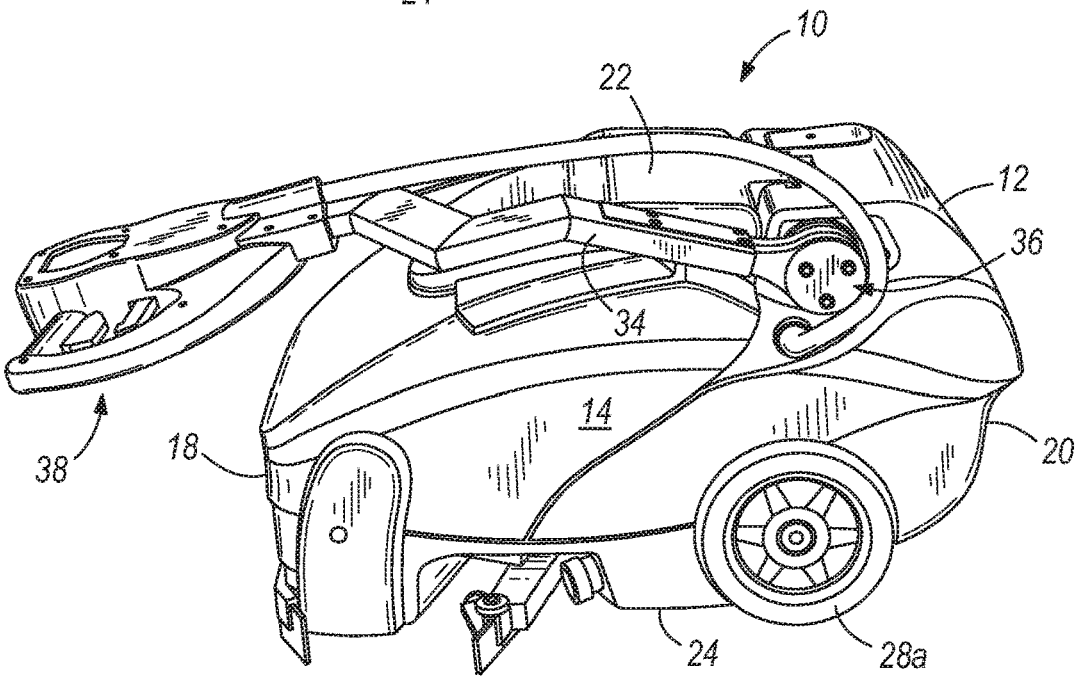
FIG. 7 is a left side perspective view of the floor cleaning tool of FIGS. 1-6, shown with the handle in a second position.
Figure 8:
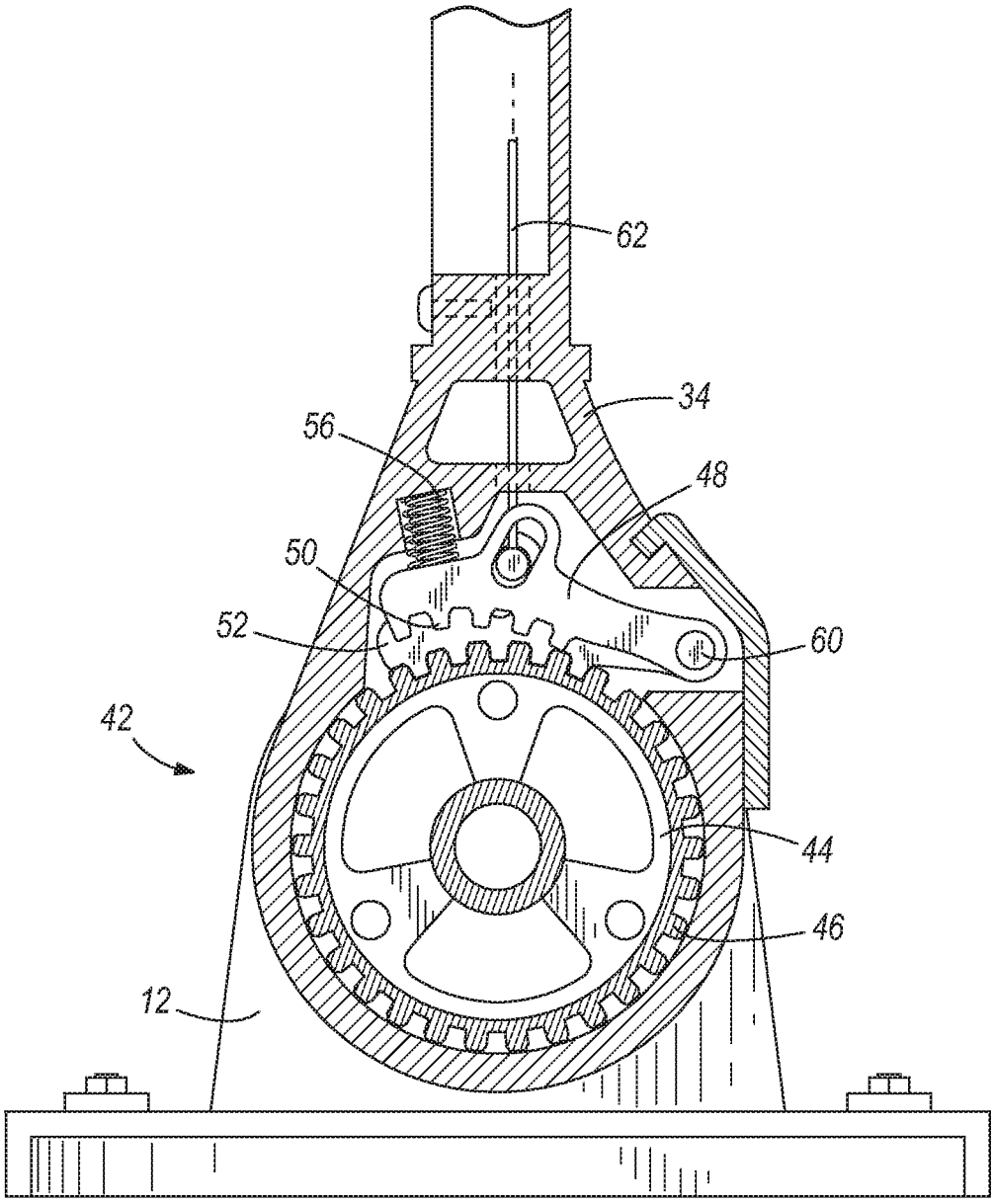
FIG. 8 is a cross-sectional view of a locking mechanism for the handle of the floor cleaning tool of FIGS. 1-7.
Figure 10:
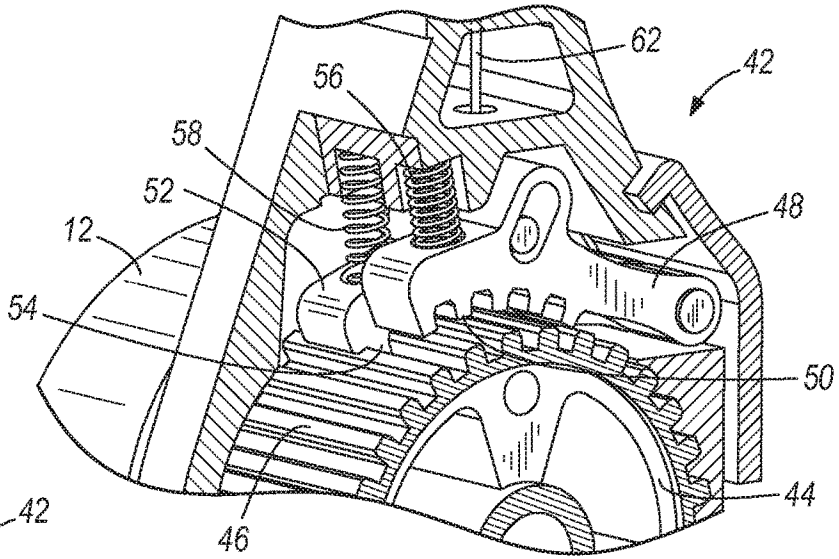
FIG. 10 is a detail perspective cross-sectional view of the locking mechanism of FIGS. 8 and 9.
Figure 11:
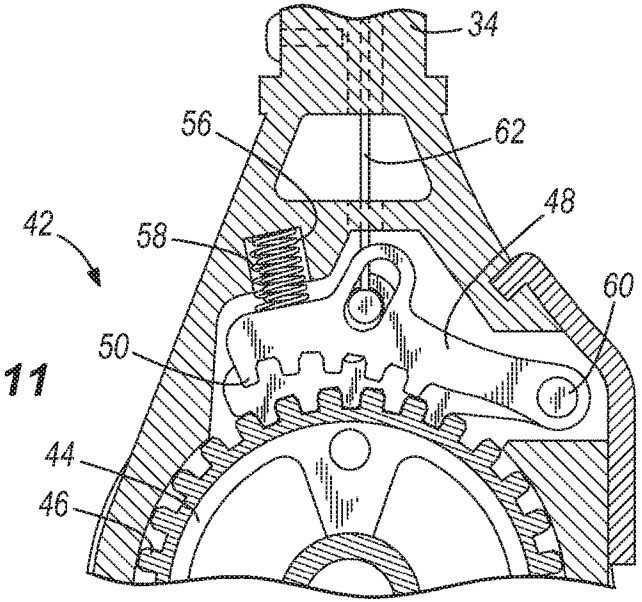
FIG. 11 is a detail cross-sectional view of the locking mechanism of FIGS. 8-10.
Figure 9:
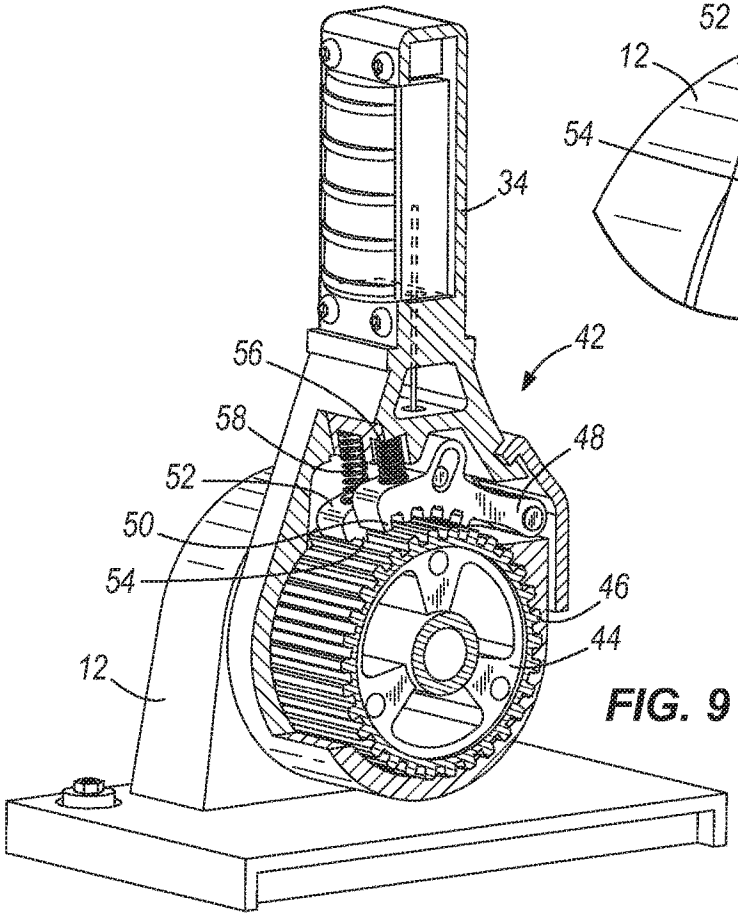
FIG. 9 is a perspective cross-sectional view of the locking mechanism of FIG. 8.
Figure 12:
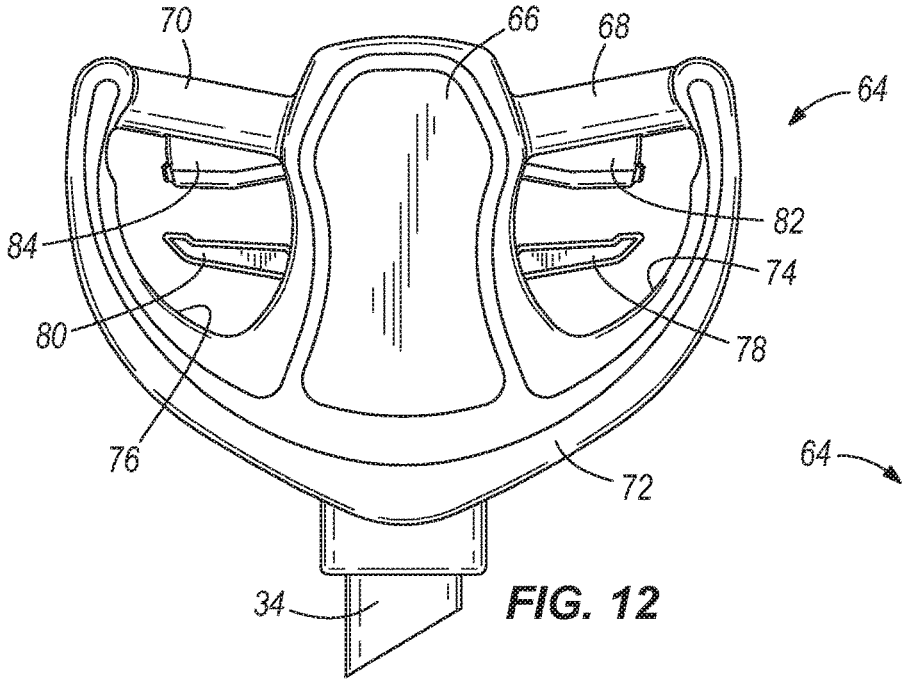
FIG. 12 is a front view of a distal end of the floor cleaning tool handle shown in FIGS. 1-7.
Figure 14:
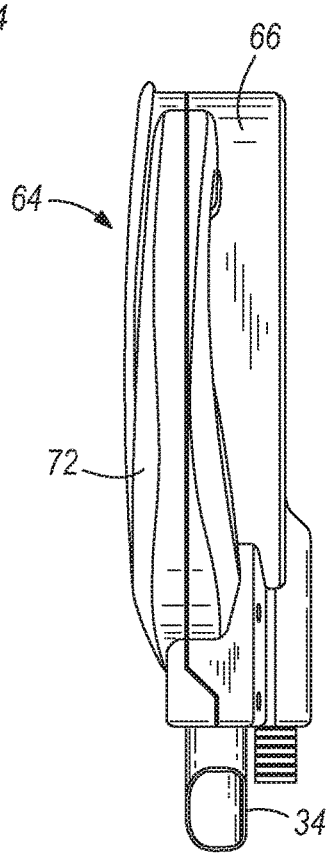
FIG. 14 is a side view of the distal end of the handle shown in FIGS. 12 and 13.
Figure 13:
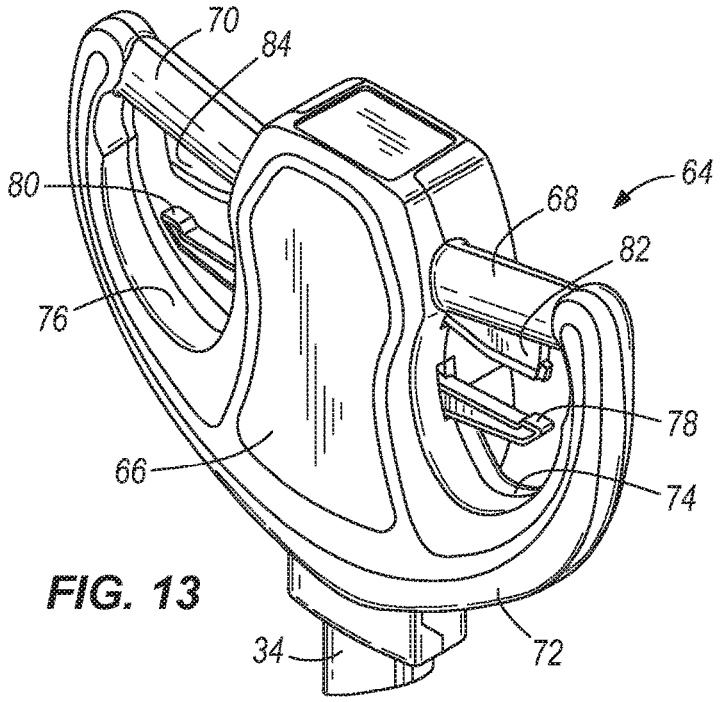
FIG. 13 is a perspective view of the distal end of the handle shown in FIG. 12.
Figure 15:
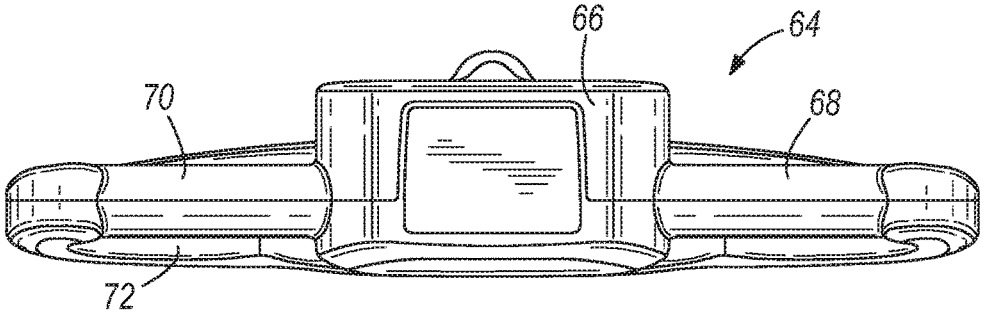
FIG. 15 is a top view of the distal end of the handle shown in FIGS. 12-14.
Figure 16:
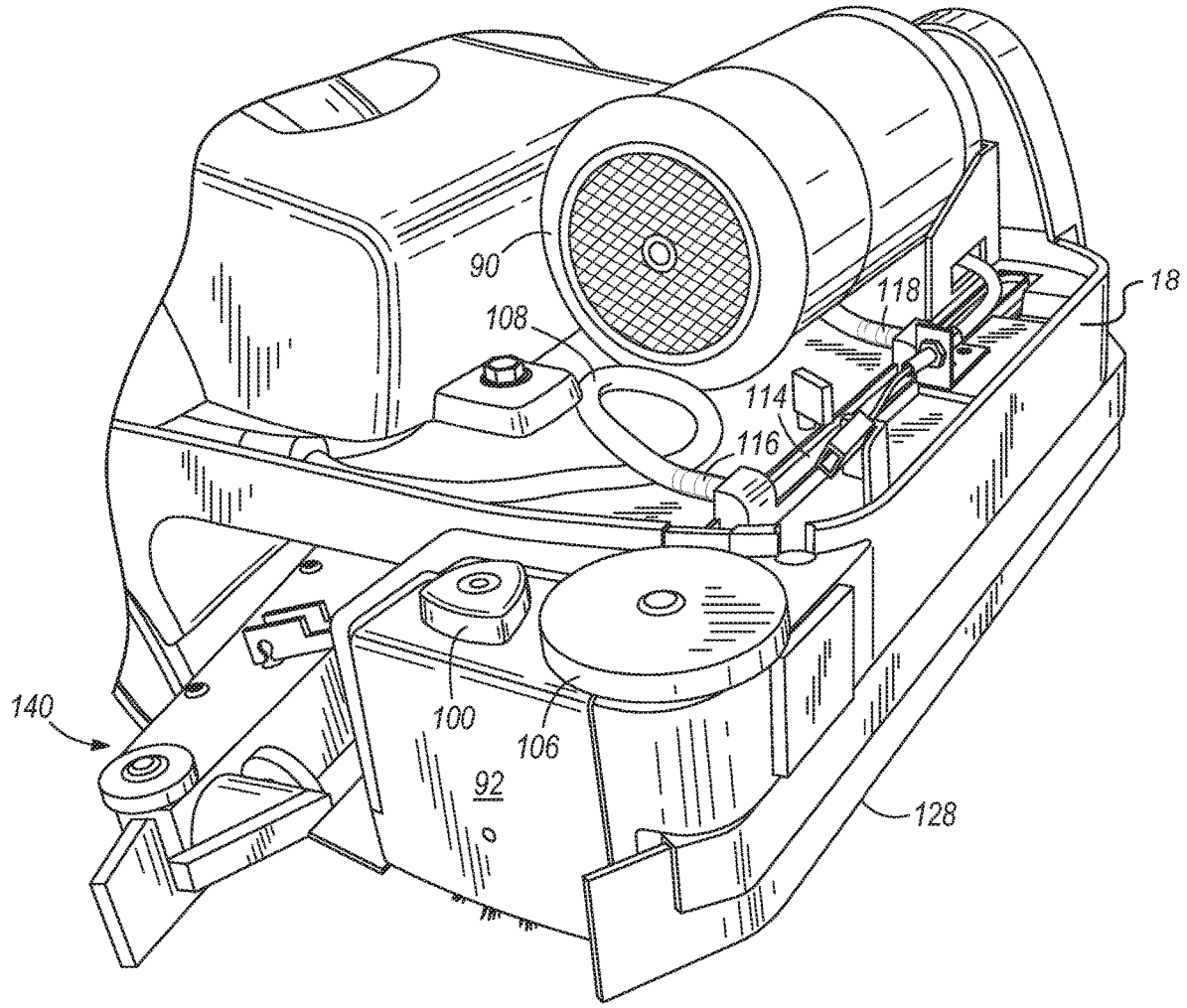
FIG. 16 is a perspective view of a front portion of the floor cleaning tool of FIGS. 1-15, shown with a cover removed.
Figure 17:
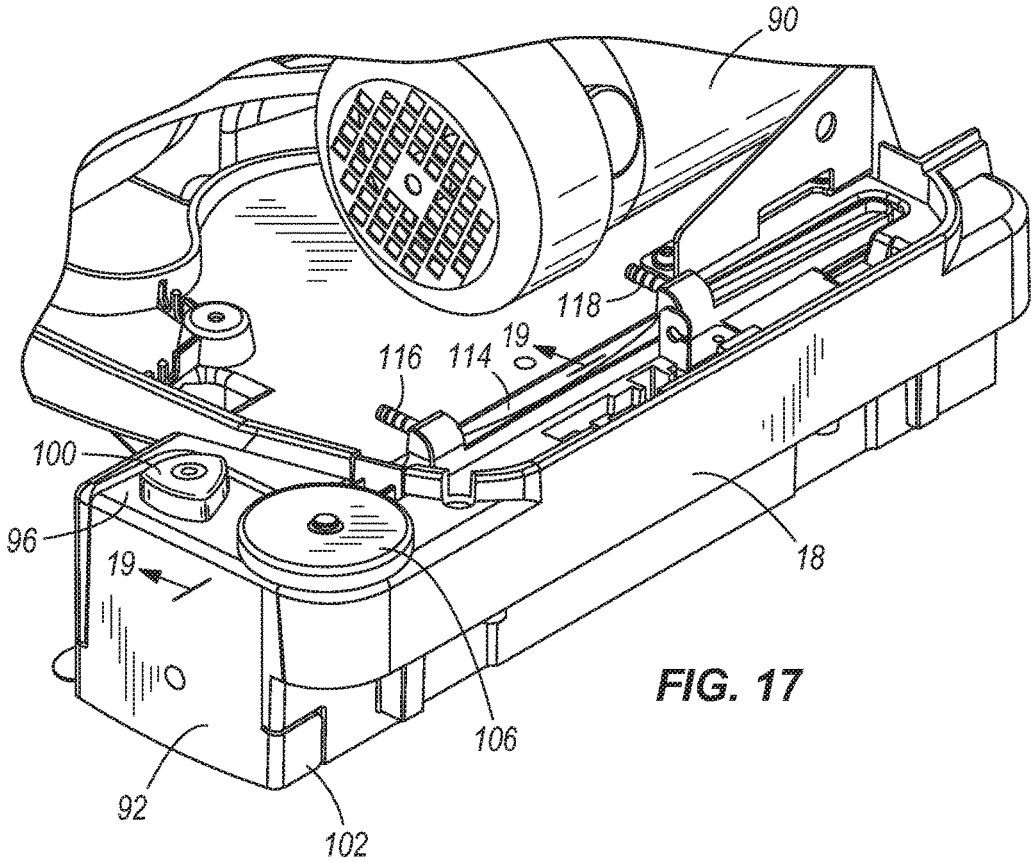
FIG. 17 is a perspective view of the front portion of the floor cleaning tool of FIGS. 1-16, shown with two covers removed.
Figure 18:
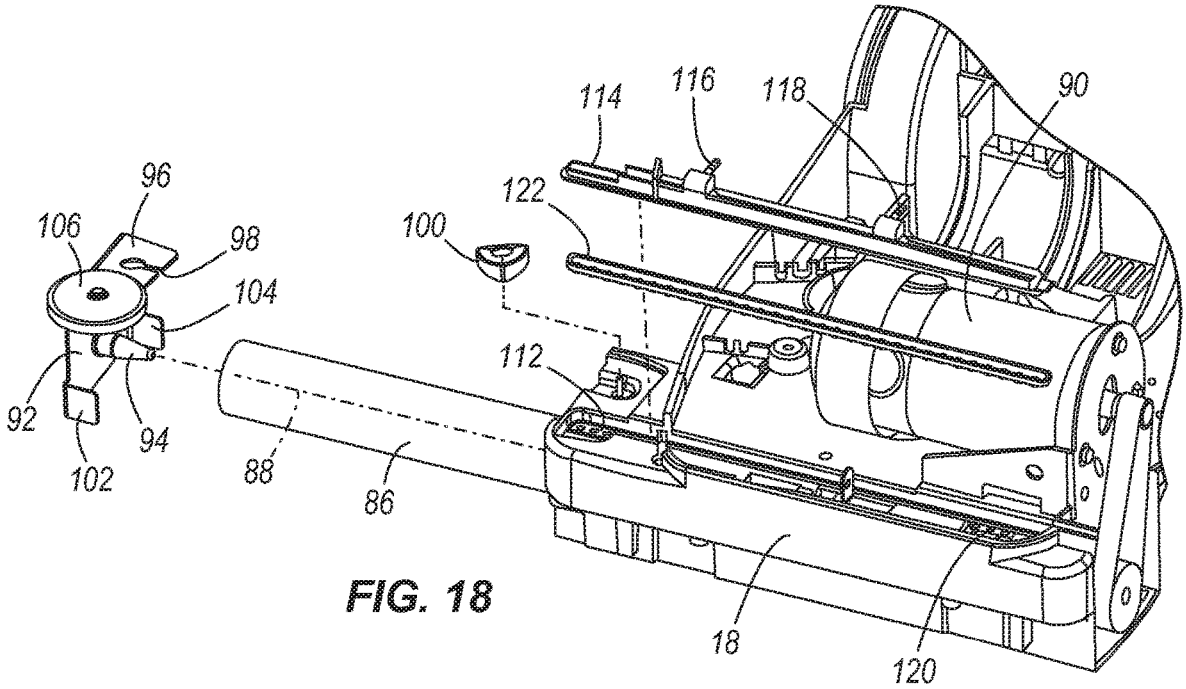
FIG. 18 is a partially exploded view of a front portion of the floor cleaning tool shown in FIGS. 1-17.

The floor cleaning tool 10 can include a lock 42 between the handle 34 and the remainder of the floor cleaning tool 10 (e.g., between the handle 34 and the housing 12) to releasably secure the handle 34 in different positions. In those embodiments in which the handle 34 is rotatable with respect to the housing 12, the lock 42 can releasably secure the handle 34 in different rotational positions with respect to the housing 12. By way of example, a first (deployed) position of the handle 34 in the illustrated embodiment is shown in FIGS. 1-6, whereas a second (stowed) position of the handle 34 is shown in FIG. 7. Any number of additional rotational positions of the handle 34 are possible, such as any number of positions intermediate and beyond those shown in FIGS. 1-7.

By virtue of the rotatability of the handle 34 and the lock 42 (described in greater detail below), a user can select a desired working position (e.g., height and angle) of the handle 34, and can lock the handle 34 in that position with the lock 42. One such lock 42 is illustrated in FIGS. 8-11. The illustrated lock 42 includes a gear 44 having at least one tooth, such as the plurality of teeth 46 about the periphery of the gear 44 shown in FIGS. 8-11. The gear 44 shown in FIGS. 8-11 is secured against rotation. Although the gear 44 shown in FIGS. 8-11 is round, and is shown as a discrete element secured to the body 12 of the floor cleaning tool 10, it will be appreciated that the gear 44 can be defined by any feature of the floor cleaning tool 10, and can be a separate part attached to the floor cleaning tool or can be integral with or defined by any portion of the floor cleaning tool 10. For example, the gear 44 can be defined by a set of teeth or apertures in the body, a frame, or other element of the floor cleaning tool 10.

The lock 42 can also include one or more pawls movable to releasably engage the teeth 46 of the gear 44. At least one such pawl can be coupled to the handle 34 to selectively engage the gear 44, and can have one or more teeth or other protrusions shaped for this purpose. In the illustrated embodiment, two pawls 48 and 52 are coupled to the handle 34 for rotation about a pin 60, although any other manner of rotational movement is possible. The first pawl 48 of the illustrated embodiment includes first teeth 50 and a second pawl 52 includes second teeth 54 (see FIGS. 9 and 10). Both sets of teeth 50, 54 are sized and shaped to releasably engage the teeth 46 of the gear 44. In the illustrated embodiment, the teeth 50 of the first pawl 48 are circumferentially offset with respect to the teeth 54 of the second pawl 52. In this manner, at least one pawl 48, 52 can engage the gear 44 in a number of rotational positions of the handle 34 with respect to the body 12. In some embodiments, only one of the pawls 48, 52 is engaged with the gear 44 in any particular rotational position of the handle 34.

By providing the circumferentially offset relationship of the teeth 50 of one pawl 48 with respect to the teeth 54 of another pawl 52 in the lock 42, more locked rotational positions of the handle 34 are possible without requiring the use of smaller teeth 46, 50, and/or 54—a feature that can provide a stronger and more durable lock 42. The offset relationship between teeth 50, 54 of different pawls 48, 52 can also reduce the wear on each of the first and second pawls 48 and 52 because each pawl 48 and 52 is utilized about half of the time, thus lengthening the operating life of the pawls 48 and 52.

In some embodiments, the first teeth 50 and the second teeth 54 can have substantially an identical configuration, although different configurations of the teeth 50, 54 are possible. Also, although each tooth of a set of teeth on a pawl 48, 52 can be substantially identical, in some embodiments (e.g., the illustrated embodiment of FIGS. 8-11), one or more of the first teeth 50 and the second teeth 54 can have a different shape than the others on the same pawl 48, 52. By using teeth 50, 54 of different shapes on the same pawl 48, 52, it is possible to enhance the ability of the pawls 48, 52 and gear 44 to resist movement of the handle 34 in both directions. For example, in the illustrated embodiment, a first end tooth of at least one of the first and second sets of teeth 50, 54 is shaped to resist rotation of the handle 34 in a clockwise direction, whereas a second end tooth of at least one of the first and second teeth 50, 54 is shaped to resist rotation of the handle 34 in a counterclockwise direction.

One or more biasing members can be utilized to bias the first and second pawls 48, 52 (and therefore, the first and second sets of teeth 50 and 54) into engagement with the gear teeth 46. In the illustrated embodiment, a first spring 56 is positioned to bias the first pawl 48 against the gear 44, and a second spring 58 is positioned to bias the second pawl 52 against the gear 44. The illustrated springs 56 and 58 are coil springs, but other biasing members can be utilized, such as leaf springs, torsion springs, elastomeric bands, blocks, or other elements, magnets and magnet sets, and the like.

Although the floor cleaning tool 10 of the illustrated embodiment has two pawls 48, 52 for releasable engagement with a gear 44 as described above, it will be appreciated that a single pawl 48, 52 can instead be used, or that three or more pawls 48, 52 can be used, and can be offset as also described above for greater adjustability of the handle 34.

The pawls 48, 52 of the lock 42 can be released by a user in order to permit the handle 34 to rotate to a desired position. To this end, a user-manipulatable actuator can be connected to the pawls 48, 52 in order to pull the pawls 48, 52 out of engagement with the gear 44. In the illustrated embodiment, for example, a flexible actuator, such as the illustrated cable 62, is coupled to the first and second pawls 48 and 52. The cable 62 is also coupled to a user manipulable control (described in greater detail below). Actuation of the cable 62 pulls the first and second pawls 48, 52 out of engagement of the gear 44 and against the biasing force of the first and second springs 56 and 58. When the user releases the user manipulable control, the springs 56 and 58 bias the respective pawl 48 and 52 back against the gear 44, such that at least one of the first teeth 50 and the second teeth 54 engage the gear teeth 46 to retain the handle 34 in a fixed rotational position with respect to the housing 12.

In the illustrated embodiment, the pawls 48, 52 are carried by the handle 34, and rotate to different positions upon rotation of the handle 34, whereas the gear 44 is stationary with respect to the rest of the floor cleaning tool 10. However, in other embodiments, these elements of the lock 42 can be reversed in position while still performing the same or similar functions described above. In particular, the pawls 48, 52 can be carried adjacent the handle 34 and can still be connected to a user-manipulatable control on the handle 34, while the gear 44 can be carried by and movable with the handle 34 for adjustment thereof.

As shown in the illustrated embodiment of the present invention, the distal end 38 of the handle 34 of the floor cleaning tool 10 can be provided with one or more locations where a user can grip the handle 34, and one or more user-manipulatable controls by which functions of the floor cleaning tool 10 can be performed. The user manipulable control of the floor cleaning tool illustrated in FIGS. 12-15 is presented by way of example, and includes a hand grip portion 64 positioned at the distal end 38 of the handle 34. The hand grip portion 64 can include a central horn 66 having first and second grips 68 and 70 extending therefrom to provide graspable portions for a user. In some embodiments, the grips 68, 70 are generally cylindrical in shape, lie in a common plane, and converge together to define an obtuse angle therebetween (i.e., to create a generally chevron shape). Other grip shapes and orientations are possible. The illustrated hand grip portion 64 also includes a C- or U-shaped portion 72 extending from an end of the first grip 68, around the horn 66, and to an end of the second grip 70. The C-shaped portion 72 can be attached to and at least partially covers an outboard end of each grip 68, 70, and can be attached to the distal end 38 of the handle 34 in any suitable manner. The grips 68, 70, central horn 66, and C- or U-shaped portion 72 cooperate to define a first aperture 74 and a second aperture 76.

The hand grip portion 64 can include any of a number of user-manipulatable controls connected to components of the floor cleaning tool 10 to control (for example) speed and direction of the floor cleaning tool 10 across a surface, dispense of a cleaning product by the floor cleaning tool 10, recovery of the cleaning product, movement of the pawls 48 and 52 to adjust the handle position (described in greater detail above), and the like.

The illustrated hand grip portion 64 includes a first actuator 78 extending from the horn 66 into the first aperture 74, and a second actuator 80 extending from the horn 66 into the second aperture 76. In some embodiments, the first and second actuators 78, 80 are operable to control at least one of dispensing and recovering a cleaning solution and releasable securing the handle 34. The illustrated hand grip portion 64 further includes a third actuator 82 extending from the first cylindrical portion 68 into the first aperture 74, and a fourth actuator 84 extending from the second cylindrical portion 70 into the second aperture 76. In some embodiments, the third and fourth actuators 82 and 84 are operable to control at least one of speed and direction of movement of the floor cleaning tool 10. Further actuators can be provided on the horn 66, as desired. Also, any of the actuators described above can perform multiple functions, such as to also provide a connection location for the cable 62 extending to the handle lock 42 described above (thereby generating retraction of the pawls 48 and 52 from engagement with the gear 44 when actuated).

The actuators 78, 80, 82 and 84 illustrated in FIGS. 12-15 are positioned within the first and second apertures 74 and 76 to inhibit accidental actuation, although any other locations of the actuators on the hand grip portion 64 are possible. Also, the first and second apertures 74 and 76 shown in FIGS. 12-15 are shaped and dimensioned to be graspable by a user, such that a user's fingers can extend through at least a portion of the first and second apertures 74 and 76.

The floor cleaning tool 10 can support a number of different cleaning implements. In the embodiment illustrated in FIGS. 16-22, the floor cleaning tool 10 supports a roller 86 coupled for rotation with respect to the housing 12 and positioned to engage a floor surface. The roller 86 can take any cleaning implement form desired, and in the illustrated embodiment is a brush roller. The roller 86 is positioned on the bottom 24 of the housing 12 near the front 18 of the housing 12, and extends along a roller axis 88, which can be substantially parallel to the handle axis 40 described above. The roller 86 can be coupled for rotation by a motor 90 or other suitable driving arrangement in any manner desired, such as by a belt and pulley or chain and sprocket connection, a direct drive connection, a geared connection, and the like.

The roller 86 in the illustrated embodiment is supported for rotation by a bracket 92. The bracket 92 can have a spindle 94 extending therefrom and sized to support the roller 86 for rotation. Alternatively, the bracket 92 can have a socket within which a spindle of or connected to the roller 86 is rotatably received. The bracket 92 can include a first flange 96 extending into mating engagement with an aperture (e.g., a recess) in the housing 12. The illustrated first flange 96 extends in a substantially axial direction with respect to the axis of rotation 88 of the roller 86, and defines an aperture (e.g., slot 98 in FIGS. 16-22) for receiving a fastener therethrough. In the illustrated embodiment, a single fastener 100 is utilized to secure the bracket 92 to the housing 12, can be loosened or tightened by hand (i.e., without the use of tools), and can be threaded into and out of a threaded aperture in the housing 12 or other structural member of the floor cleaning tool 10. The bracket 92 can also include a second flange 102 and a third flange 104, either of both of which extend in a substantially axial direction with respect to the axis of rotation 88 of the roller 86 for mating engagement with respective apertures (e.g., recesses) in the front 18 of the housing 12. Any two or more of the flange engagements described above can cooperate to inhibit rotation of the bracket 92 with respect to the housing 12.

It will be appreciated that other sizes, shapes, quantities and locations of flanges 96, 102 and 104 (any or all of which can be axially extending to matingly engage with the housing 12 or other structural member of the floor cleaning tool 10) are possible and are considered to be within the scope of the present invention. The bracket 92 can also include one or more wall rollers 106 positioned to engage a wall surface and inhibit the floor cleaning tool 10 from scratching or otherwise damaging the wall surface.

With continued reference to the floor cleaning tool embodiment illustrated in FIGS. 16-22, the roller 86 can be removed without the use of tools by rotating the single fastener 100 by hand, removing the bracket 92 from the housing 12, and laterally (axially) withdrawing the roller 86 from the housing 12. In some cases, removal of the bracket 92 from the housing 12 is sufficient to disengage the roller 86 from the housing 12, whereas in other embodiments, the roller 86 is moved laterally (axially) to cause such disengagement as well as to remove the roller 86. In some embodiments, the roller 86 is conveniently removable from the housing 12 in a purely lateral (axial) direction. The roller 86 can be cleaned and re-inserted, or can be replaced by a new and/or different roller suitable for a different floor cleaning operation. The roller 86 can be replaced in the illustrated embodiment without the use of tools inserting the roller 86 into the housing 12 in a purely lateral (axial) direction. The bracket 92 can then be positioned on the housing 12 such that the flanges 96, 102 and 104 matingly engage the housing 12. The fastener 100 can then be re-attached to the housing 12 to secure the bracket 92 to the housing 12. The fastener 100 can be tightened by hand, without the use of tools. In this manner, the bracket 92 can be positioned exterior to the housing 12 and exterior to the roller 86, and can be quickly and conveniently removed and replaced by hand by a user for access to the roller 86 inside.

Figure 19:
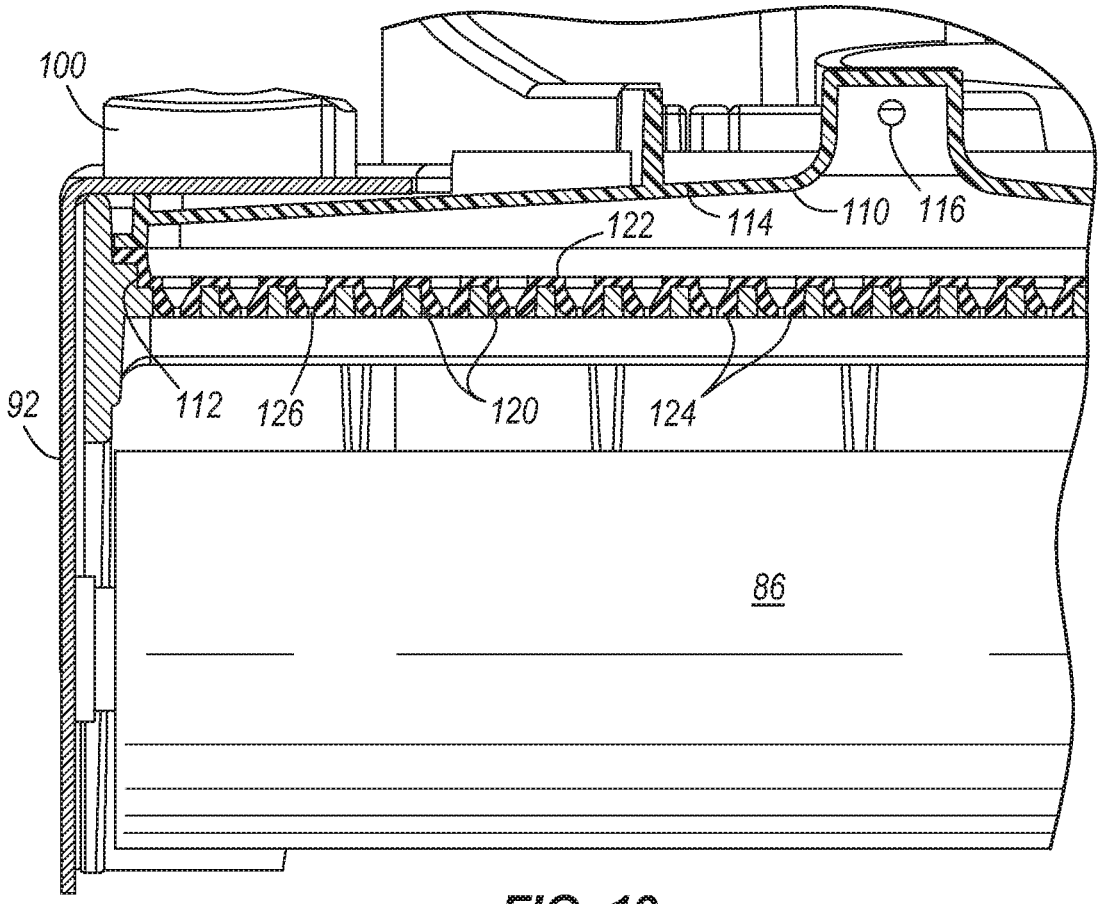
FIG. 19 is a cross-sectional view of a front portion of the floor cleaning tool shown in FIGS. 1-18.
Figure 20:
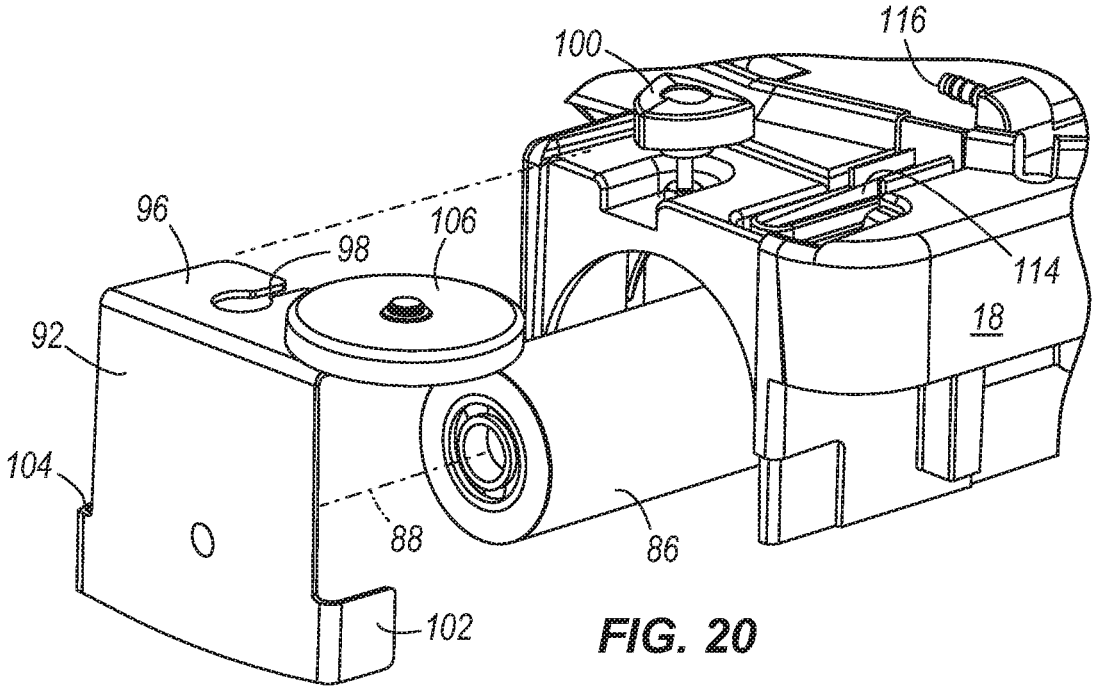
FIG. 20 is a partially exploded perspective detail view of a front portion of the floor cleaning tool shown in FIGS. 1-19.
Figure 21:
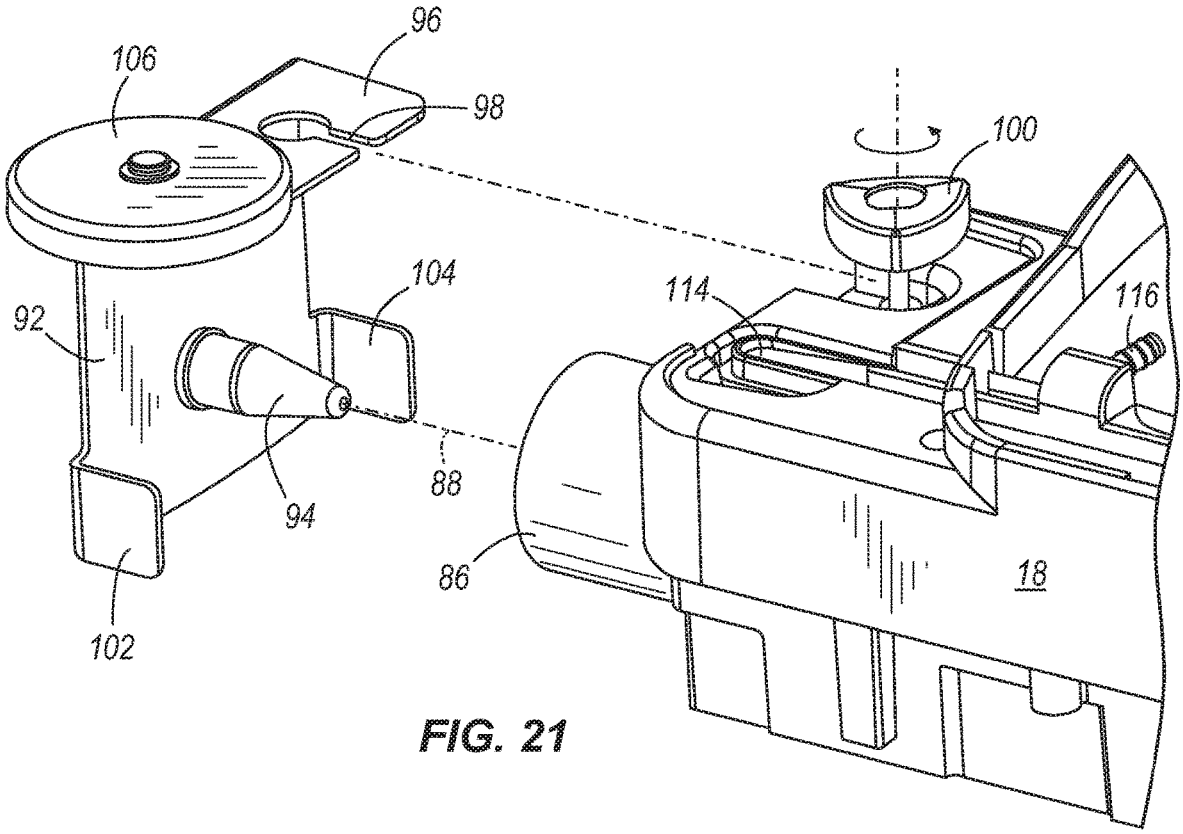
FIG. 21 is another partially exploded detail view of a front portion of the floor cleaning tool shown in FIGS. 1-20.
Figure 22:
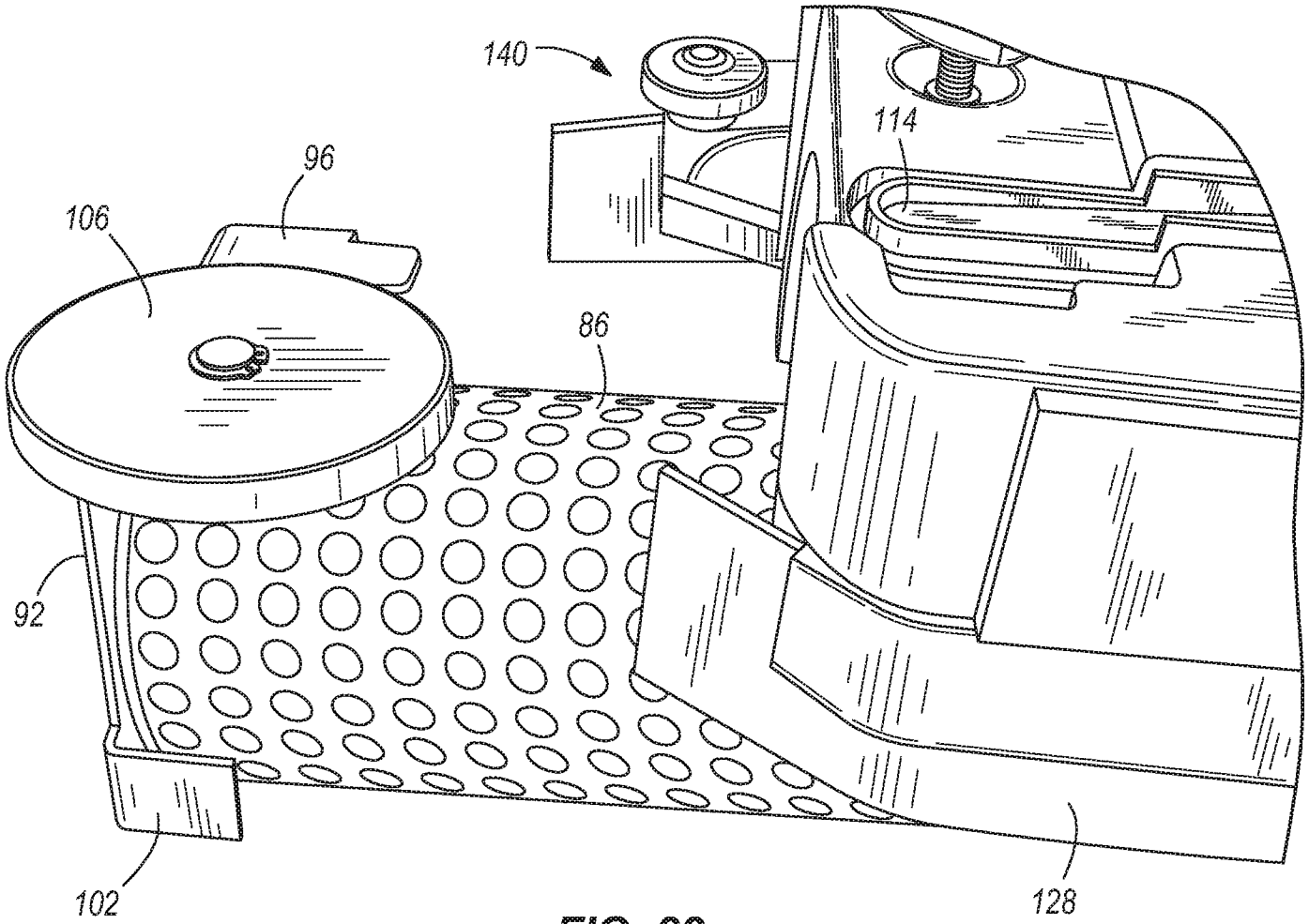
FIG. 22 is a partially exploded detail view of a front portion of the floor cleaning tool shown in FIGS. 1-21.

Some embodiments of the present invention include one or more lengths of conduit 108 fluidly coupled to the first reservoir 30 to direct fluid from the first reservoir 30 to one or more fluid chambers 110 (see single fluid chamber 110 in FIG. 19, for example). The fluid chamber 110 can be defined by a recess 112 in the housing 12 and a cover plate 114 coupled to the housing 12, although any other combination of housing and additional components defining the fluid chamber 110 is possible, and falls within the spirit and scope of the present invention.

The illustrated cover plate 114 includes a first inlet 116 and a second inlet 118 fluidly coupled to respective conduits 108 leading to the first reservoir 30, although any number of inlets and conduits 108 supplying liquid from the first reservoir are possible. The illustrated recess 112 of the fluid chamber 110 defines a plurality of apertures 120 that are aligned substantially along a line. In other embodiments, the plurality of apertures 120 can be arranged in any other manner desired, such as in a staggered fashion, in two or more rows of apertures 120, and the like. Also, the apertures 120 in the illustrated embodiment are substantially round, although any other shape or combination of aperture shapes having larger or smaller sizes can be used as desired, such as elongated apertures separated by the same, larger, or smaller distances, star-shaped apertures in any desired arrangement, and the like.

Figure 23:
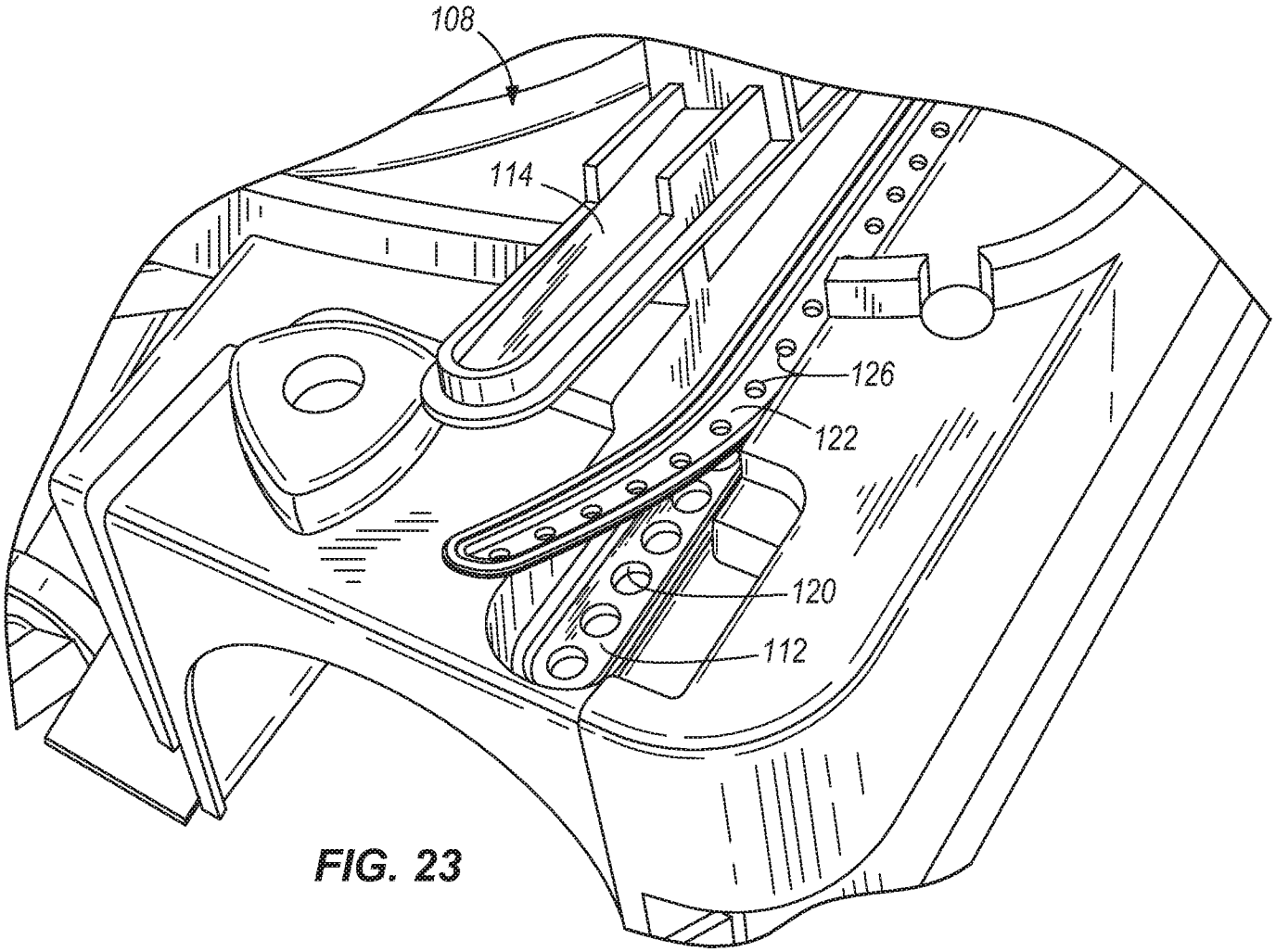
FIG. 23 is a partially exploded perspective detail view of a front portion of the floor cleaning tool shown in FIGS. 1-22, shown with a nozzle plate partially installed.
Figure 24:
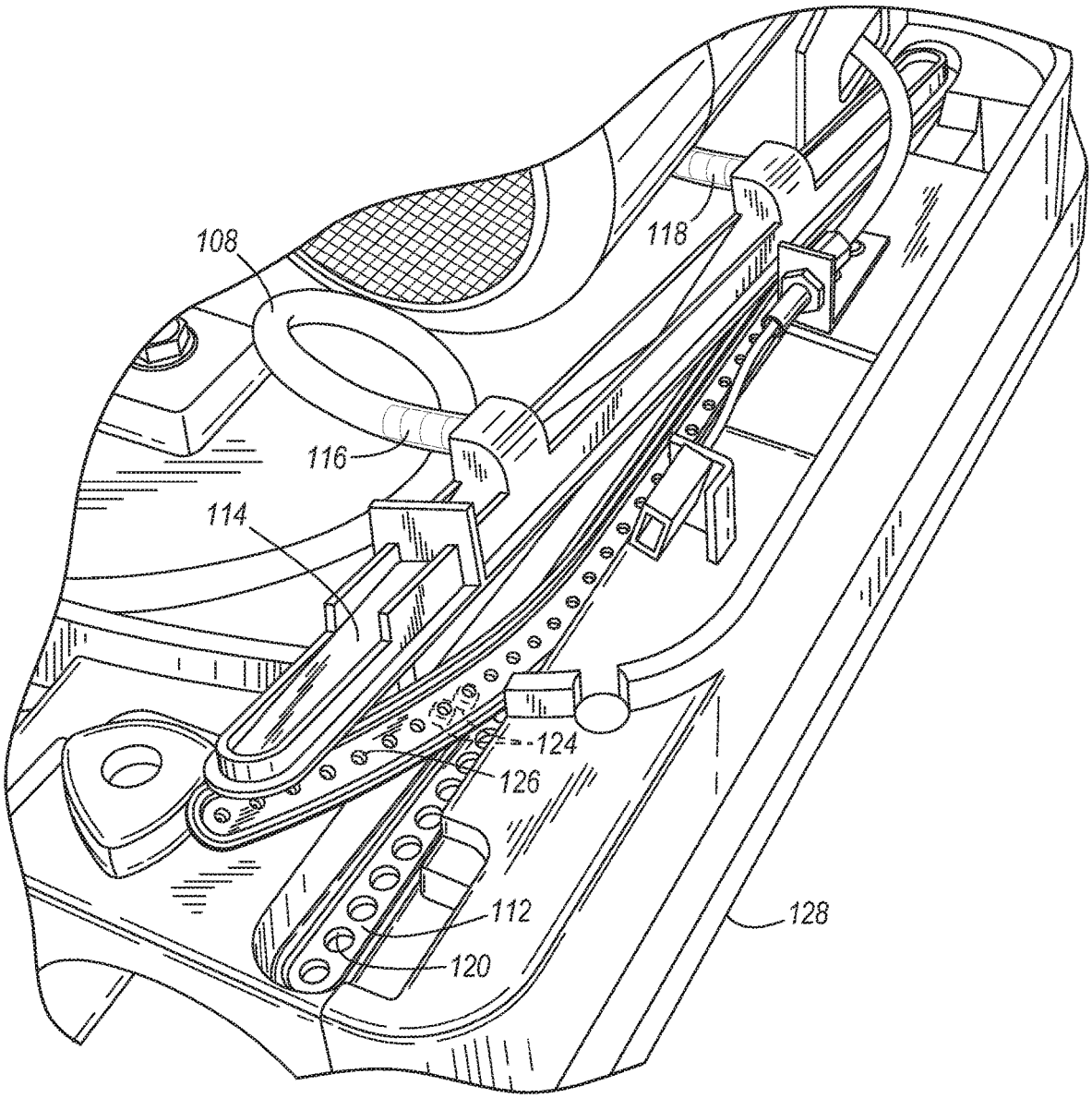
FIG. 24 is another partially exploded perspective detail view of the front portion of the floor cleaning tool shown in FIG. 23.
Figure 25:
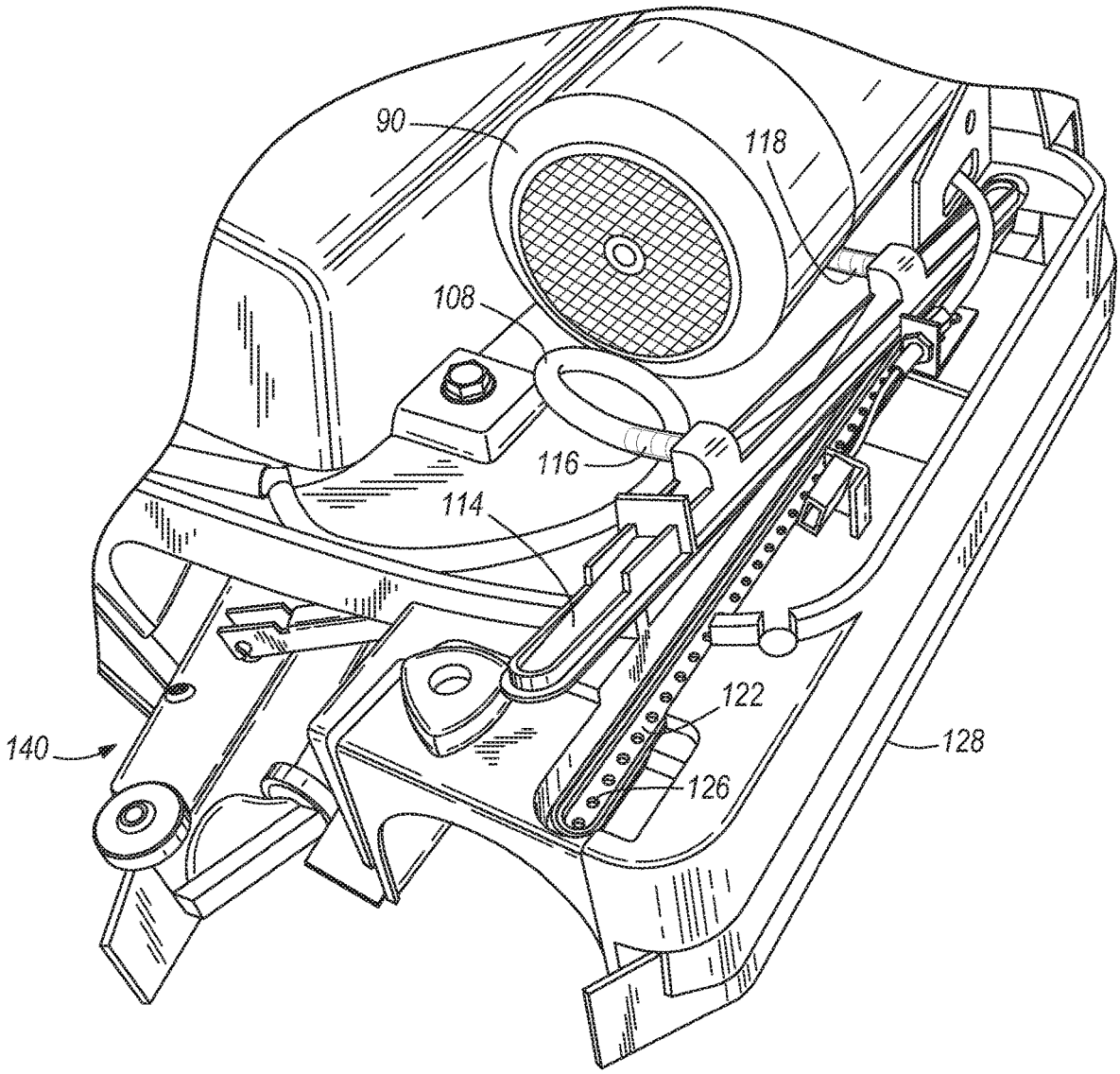
FIG. 25 is another partially exploded perspective detail view of the front portion of the floor cleaning tool shown in FIGS. 22 and 23, shown with the nozzle plate fully installed.
Figure 26:
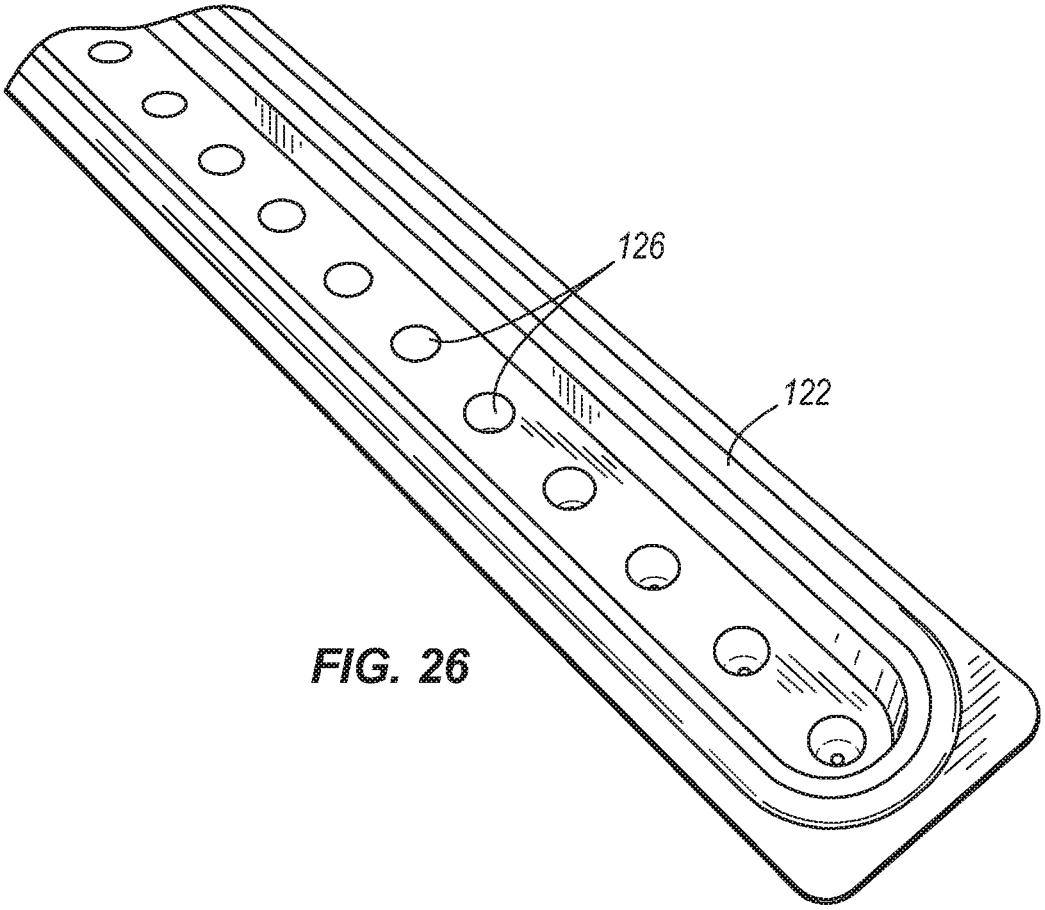
FIG. 26 is a top perspective detail view of the nozzle plate of the floor cleaning tool shown in FIGS. 1-25.
Figure 27:
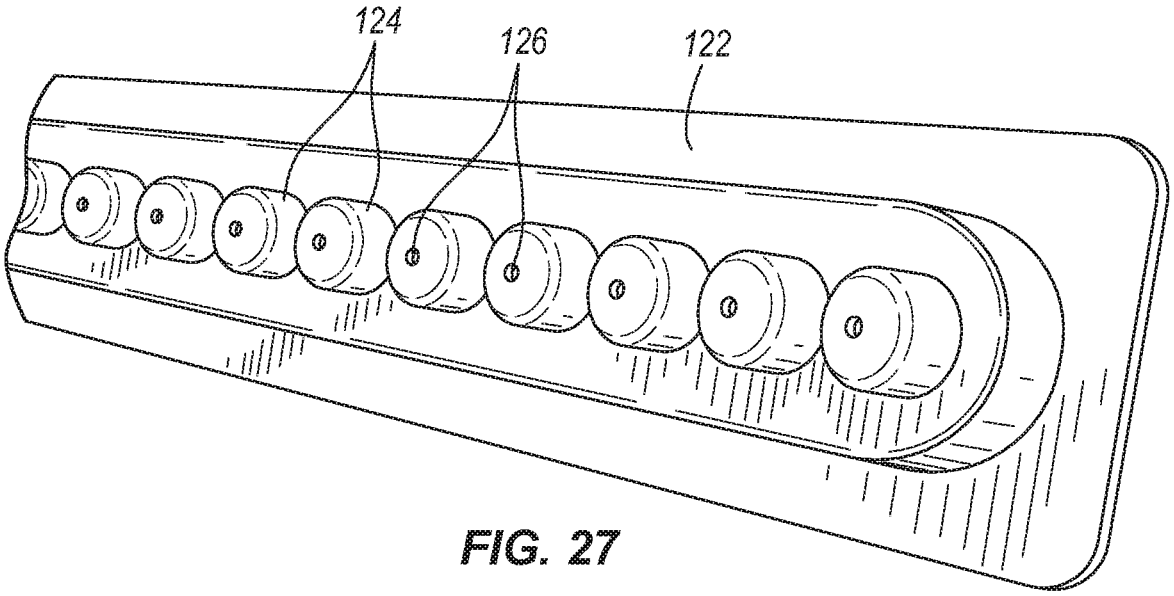
FIG. 27 is a bottom perspective detail view of the nozzle plate of the floor cleaning tool shown in FIGS. 1-26.
Figure 28:
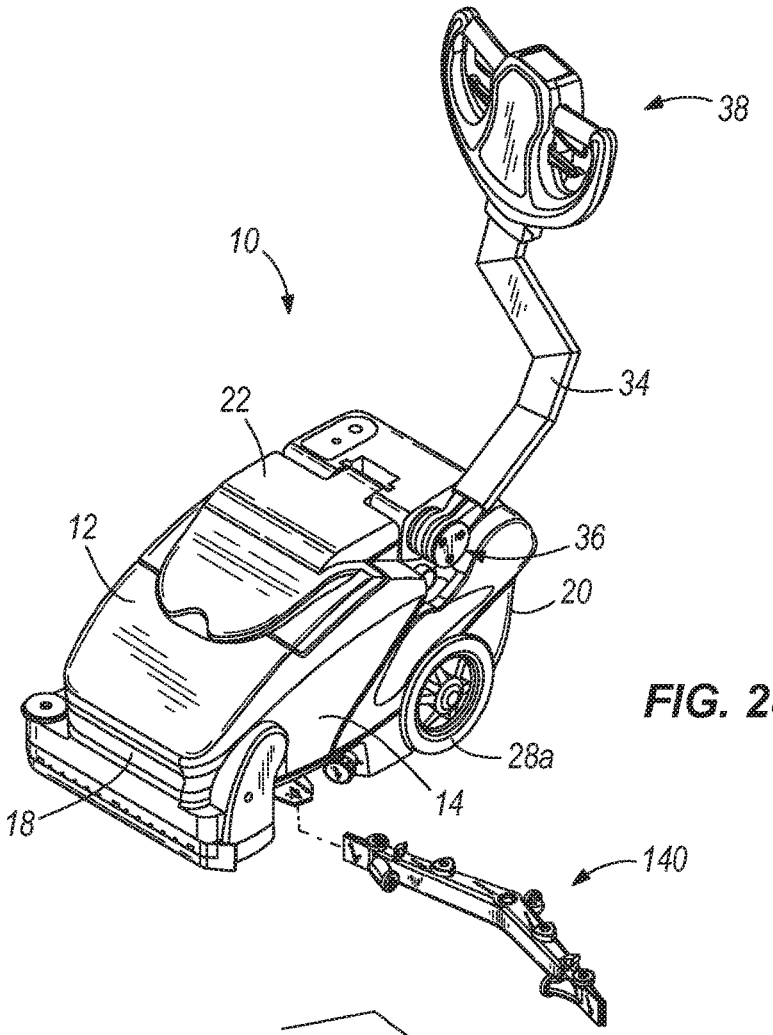
FIG. 28 is a partially exploded perspective view of the floor cleaning tool shown in FIGS. 1-27, shown with a squeegee assembly prior to installation.
Figure 29:
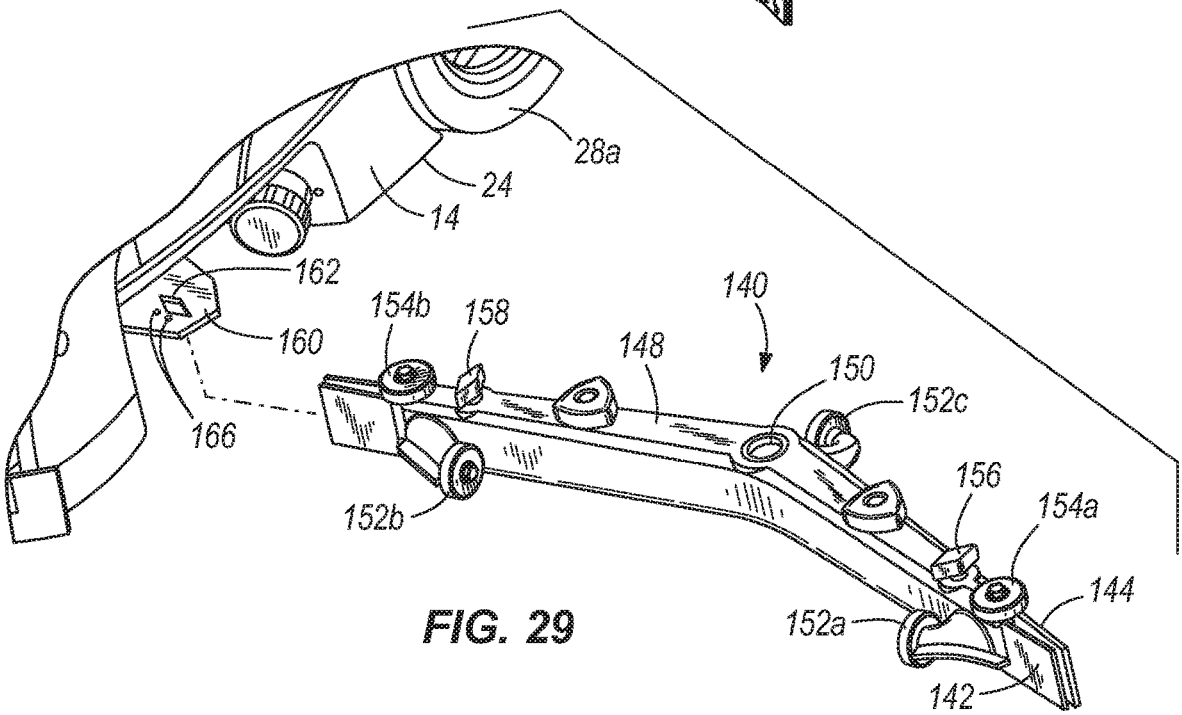
FIG. 29 is a perspective detail view of the squeegee assembly and floor cleaning tool shown in FIGS. 1-28.
Figure 30:
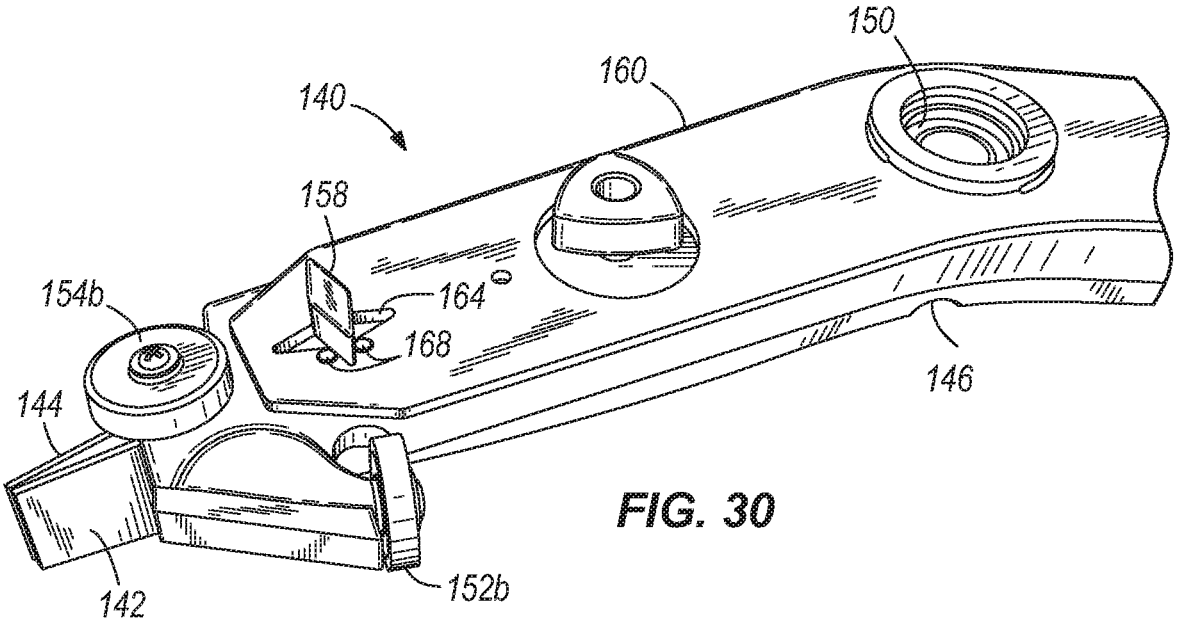
FIG. 30 is a perspective detail view of the squeegee assembly of the floor cleaning tool shown in FIGS. 1-29, shown installed on a floor cleaning tool mount.
Figure 31:
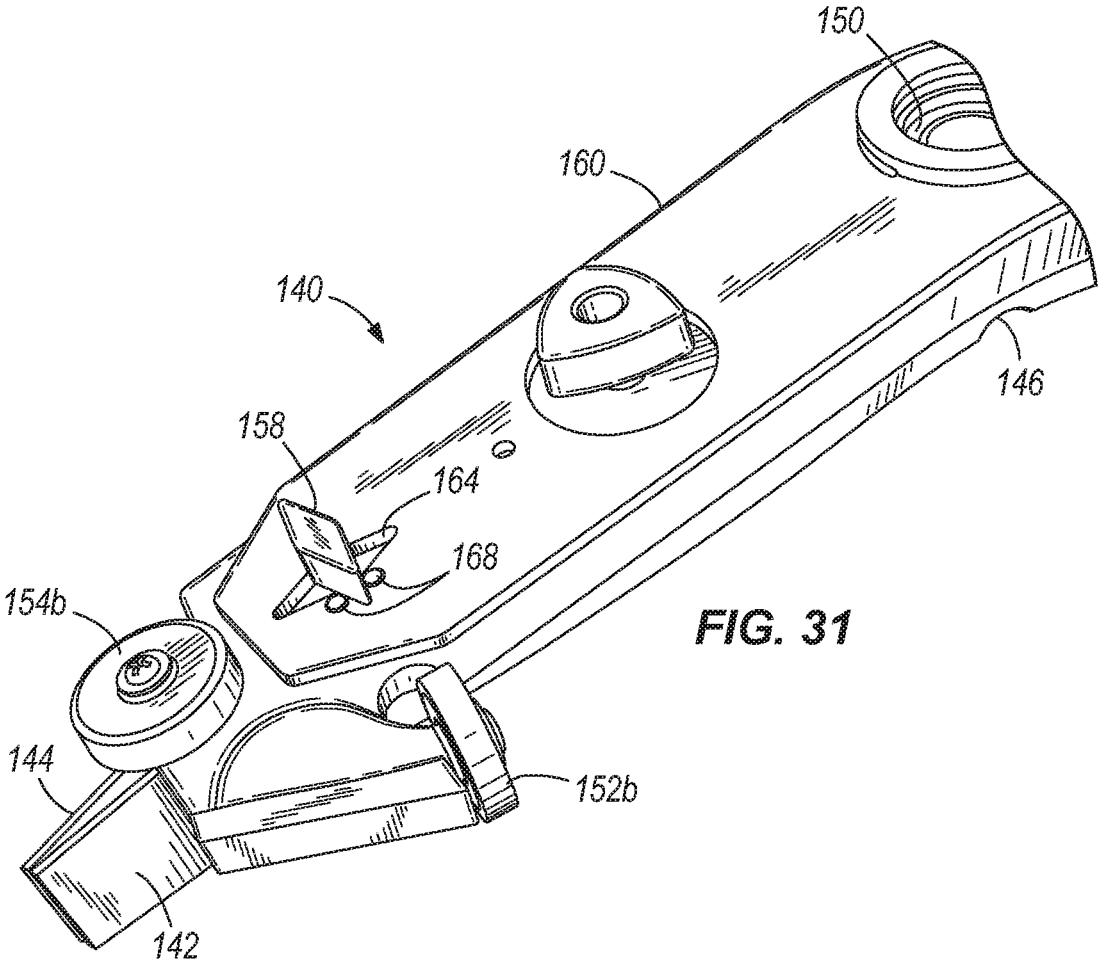
FIG. 31 is another perspective detail view of the squeegee assembly of the floor cleaning tool shown in FIGS. 1-30, shown installed on a floor cleaning tool mount.
Figure 32:
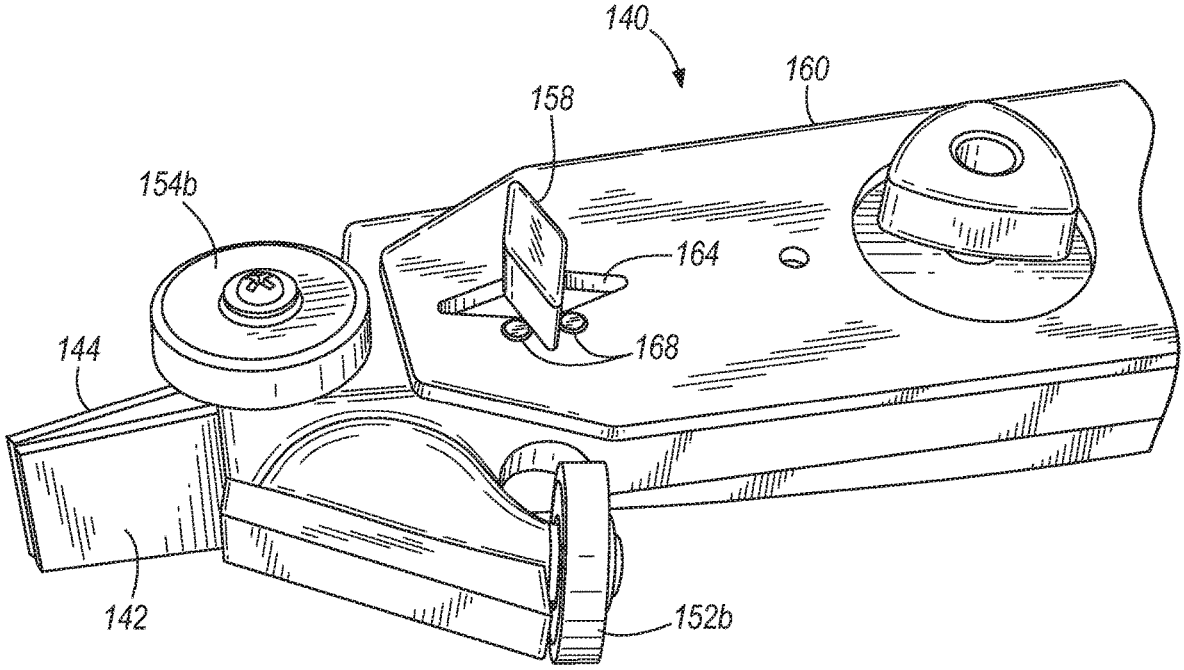
FIG. 32 is another perspective detail view of the squeegee assembly of the floor cleaning tool shown in FIGS. 1-31, shown installed on a floor cleaning tool mount.

A nozzle plate 122 can be positioned in the recess 112, and can be shaped to have a plurality of protrusions 124 that in some embodiments can substantially correspond to the shape and size of the plurality of apertures 120 described above. As shown in FIGS. 19, 23 and 24, the plurality of protrusions 124 are each received in a respective aperture 120, and are thereby supported within the apertures 120. The protrusions 124 are shown in greater detail in FIG. 27. With reference to FIGS. 19 and 23-27, the nozzle plate 122 includes a plurality of apertures 126, such that each aperture 126 is positioned in a respective protrusion 124. The apertures 126 can have a relatively large diameter adjacent the fluid chamber 110, and a relatively small diameter below the fluid chamber 110, or in other embodiments can have a substantially constant diameter through the nozzle plate 122. The size of the relatively small diameter portion of the apertures 126 in the illustrated embodiment can help to regulate the delivery of fluid onto the floor surface.

The mating relationship between the apertured protrusions 124 of the nozzle plate 122 and the apertures 120 of the fluid chamber 110 performs the functions of registering the nozzle plate 122 in proper position within the fluid chamber 110 and providing support for the nozzle plate 122 in that position. However, it will be appreciated that these two functions can be performed in other manners, such as by receiving an apertured channel in the nozzle plate 122 within a mating open channel in the fluid chamber 110, by clamping peripheral edges of an apertured nozzle plate 122 between portions of the housing 12 at least partially defining the fluid chamber 110, and the like, any of which can utilize nozzle plates 122 having different shapes (e.g., with or without protrusions 124).

In some embodiments, the nozzle plate 122 is removable and replaceable within the fluid chamber 110. The nozzle plate 122 can be resiliently deformable, and can comprise an elastomeric or other flexible, resilient material such as rubber, neoprene, urethane, latex, and the like. The resiliently deformable nozzle plate 122 can be removed from the fluid chamber 110, cleaned, and replaced in the fluid chamber 110. The resiliently deformable nature of the nozzle plate 122 permits a user to deflect the nozzle plate 122 to ease cleaning operations, such as for removing scale, lime, and other mineral buildup on the nozzle plate 122. In some embodiments, the cleaning tool 10 can include multiple nozzle plates 122, each of which has differently numbered, arranged, sized and/or shaped apertures. This permits a user to determine the desired type and volume of cleaning solution flowing from the fluid chamber 110 to a floor surface over a given period of time. Also, a wiping blade 128 can be coupled to the front 18 of the housing 12 to strip fluid as the floor cleaning tool 10 is moved in a rearward direction. In some embodiments, the wiping blade 128 is movable to different heights (e.g., triggered by an actuator 80, described in greater detail below) to facilitate this function.

Some embodiments of the present invention include one or more squeegees for assisting in floor cleaning operations. An example of such a squeegee is used in the squeegee assembly 140 illustrated in FIGS. 28-32. The squeegee assembly 140 can be positioned to engage the bottom 24 of the floor cleaning tool 10, and is positioned between the roller 86 and the first and second wheels 28*a*, 28*b*. The squeegee assembly 140 can be positioned to engage a floor surface during operation of the floor cleaning tool 10. The illustrated squeegee assembly 140 includes a first squeegee 142 and a second squeegee 144 spaced from the first squeegee 142, although a single squeegee or three or more squeegees can instead be used in other embodiments (e.g., side-by-side with respect to one another, each following another in movement of the floor cleaning tool across a surface, and the like). The first and second squeegees 142, 144 of the illustrated embodiment have a concave shape designed to direct cleaning solution to a center of the squeegee assembly 140. Also, the first blade 142 can define a recess 146 to permit cleaning solution to enter a vacuum area between the first and second squeegees 142, 144.

The illustrated squeegee assembly 140 further includes a plate 148 coupled to and retaining an upper portion of the first and second squeegees 142, 144. The illustrated plate 148 has an aperture 150 therein, which in some embodiments can be generally aligned with the recess 146, but which in any case can be used as a location through which a vacuum is drawn from the area defined between the squeegees 142, 144, the plate 148, and the floor surface. Any number of vacuum apertures 150 can be used for this purpose. A length of conduit (not shown) can be coupled to each such aperture 150 and to the second reservoir 32 to permit recovery of cleaning product from the floor surface.

The illustrated squeegee assembly 140 also includes first, second and third vertical guide wheels 152*a*, 152*b*, 152*c* that can orient the squeegee assembly 140 at a desired height and angle with respect to the ground surface, although any other number and location of such wheels is possible in other embodiments. The squeegee assembly 140 can also include any number of horizontal guide wheels 154*a*, 154*b* that can roll when in contact with a surface (such as a wall).

The squeegee assembly 140 further includes at least one fastener operable to removably couple the squeegee assembly 140 to the floor cleaning tool 10. In the illustrated embodiment, the squeegee assembly 140 includes first and second protrusions 156, 158 on opposite sides of the squeegee assembly 140. A squeegee assembly mount 160 can be provided beneath the floor cleaning tool 10, and can be coupled to the housing 12, a frame of the tool 10, or any other structural member of the tool 10 in order to suspend or otherwise support the squeegee assembly 140 on the tool 10 when connected thereto. The squeegee assembly mount 160 illustrated in FIGS. 28-32 has first and second apertures 162, 164 on opposite sides of the squeegee assembly mount 160 (i.e., on the first side 14 of the tool 10, and on the second side 16 of the tool 10, respectively). The first aperture 162 is sized and shaped to receive the first protrusion 156 when the first protrusion 156 is in a first orientation, and is sized and shaped to retain the first protrusion 156 when the first protrusion 156 is in a second orientation. Similarly, the second aperture 164 is sized and shaped to receive the second protrusion 158 when the second protrusion 158 is in a first orientation, and sized and shaped to retain the second protrusion 158 when the second protrusion 158 is in a second orientation. In some embodiments, the first orientation is rotated about 90 degrees from the second orientation. In the illustrated embodiment, the apertures 162, 164 and the protrusions 156, 158 are generally diamond-shaped, and the apertures 162, 164 are closed (i.e., not open to an edge of the squeegee assembly mount 160). However, other aperture and protrusion numbers, shapes, sizes, and locations can be utilized to selectively couple the squeegee assembly 140 to the floor cleaning tool 10.

The squeegee assembly mount 160 can include one or more detents or protrusions to retain the protrusions 156, 158 in their first and/or second orientations. In the illustrated embodiment, two projections 166, 168 are positioned on the squeegee assembly mount 160 to retain the first and second protrusions 156, 158 in their respective second orientations.

In some embodiments, the squeegee assembly 140 can be removed without the use of tools by rotating the protrusions 156, 158 from their respective second orientations to their respective first orientations, and then lowering the squeegee assembly 140 to draw the protrusions 156, 158 through and out of their respective apertures 162, 164 in the squeegee assembly mount 160. The squeegee assembly 140 can then be laterally removed from the floor cleaning tool 10 either at the first side 14 or at the second side 16 of the floor cleaning tool. Accordingly, the squeegee assembly 140 can be removed in a vertical, then horizontal and lateral direction from between the roller 86 and the wheels 28*a*, 28*b* of the floor cleaning tool 10 without lifting or tilting the floor cleaning tool 10. The squeegee assembly 140 can then be cleaned, serviced, repaired (for example, by replacement of one or more of the blades 142, 144) or exchanged, and then the new or repaired squeegee assembly 140 can be inserted. The squeegee assembly 140 can be coupled to the housing 12 without the use of tools by laterally inserting the squeegee 140 into the housing 12 in a lateral direction between the roller 86 and the wheels 28*a*, 28*b* of the floor cleaning tool 10. The squeegee assembly 140 can then be raised in a vertical direction to insert the protrusions 156, 158 into their respective apertures 162, 164 in the squeegee assembly mount 160. The protrusions 156, 158 are then rotated from their respective first orientations to their respective second orientations. The projections 166, 168 can retain the respective protrusions 156, 158 in their second orientations to retain the squeegee assembly 140 mounted on the floor cleaning tool 10. It should also be noted that the protrusions 156, 158 can be rotated by hand (i.e., without the use of tools).

The embodiments of the present invention described above and illustrated in the accompanying figures are presented by way of example only, and are not intended as a limitation upon the concepts and principles of the present invention. As such, it will be appreciated by one having ordinary skill in the art that various changes in the elements and their configuration and arrangement are possible without departing from the spirit and scope of the present invention.

The invention claimed is:

1. A floor cleaning tool comprising:

a housing;

a roller positioned in the housing and rotatable with respect to the housing about a roller axis extending in an axial direction;

a bracket having a first portion extending in the axial direction of the roller and shaped to releasably and matingly engage the housing;

a second portion including a spindle extending in the axial direction of the roller, the first portion and the spindle extending in the same axial direction toward the roller, the spindle shaped to extend into the roller and releasably and matingly engage an end of the roller, the roller rotatable with respect to the second portion of the bracket;

a third portion including a first flange and a second flange opposite the first flange, the first flange and the second flange extending in the same axial direction as the first portion, each of the first flange and the second flange shaped to matingly engage the housing on opposite sides of the roller to resist rotation of the bracket relative to the housing on insertion of the spindle into the roller; and a fastener engaged with the first portion of the bracket, the bracket releasably and removably coupled to the roller and to the housing via the fastener, wherein the bracket is positioned on the housing to laterally enclose an end of the roller when the first portion is matingly engaged with the housing.

2. The floor cleaning tool of claim 1, wherein the first portion defines an aperture shaped to receive the fastener.

3. The floor cleaning tool of claim 1, wherein the spindle supports the roller for rotation with respect to the bracket.

4. The floor cleaning tool of claim 1, wherein upon release of the fastener and removal of the bracket, the roller is removable axially from the housing.

5. The floor cleaning tool of claim 1, wherein the fastener couples the bracket and roller to the housing without use of tools.

6. The floor cleaning tool of claim 1, wherein the first portion is exterior to the housing and external to the roller.

7. The floor cleaning tool of claim 1, wherein the fastener is a single fastener that couples the bracket and roller to the housing.

8. The floor cleaning tool of claim 1, wherein the fastener defines a fastener axis substantially perpendicular to the roller axis.

9. The floor cleaning tool of claim 1, further comprising a roller wheel coupled to the bracket and positioned to engage a wall surface to inhibit contact between the bracket and the wall surface.

10. A method for coupling a roller to a floor cleaning tool having a housing, the roller having a roller axis of rotation extending in an axial direction and rotatable relative to the housing about the roller axis, the method comprising:

laterally inserting the roller onto the floor cleaning tool, the roller positioned in the housing;

coupling an end of the roller to the floor cleaning tool by mating a spindle within a receptacle;

coupling a bracket to an end of the roller;

engaging a first portion of the bracket extending in the axial direction with the floor cleaning tool;

engaging the first portion of the bracket with a fastener to secure the bracket to the floor cleaning tool, the bracket positioned on the housing to laterally enclose the roller when the first portion is matingly engaged with the housing;

supporting the roller for rotation with respect to the floor cleaning tool via the spindle in the receptacle, the first portion and the spindle extending in the same axial direction toward the roller;

engaging a first flange and a second flange of the bracket extending in the same axial direction with the housing; and resisting rotation of the bracket with respect to the floor cleaning tool via engagement of the first flange and the second flange of the bracket with the floor cleaning tool on opposite sides of the roller on insertion of the spindle into the receptacle.

11. The method of claim 10, further comprising rotating the fastener about an axis perpendicular to the roller axis of rotation to secure the bracket to the floor cleaning tool.

12. The method of claim 10, further comprising rotating the fastener without use of hand tools.

13. The method of claim 10, wherein the roller is a first roller, the method further comprising positioning a second roller on the bracket with respect to the first roller by engaging the portion of the bracket with the floor cleaning tool.

* * * * *